US005503070A

United States Patent [19]

Cheever et al.

[11] Patent Number: 5,503,070

[45] Date of Patent: Apr. 2, 1996

[54] MARKING APPARATUS WITH DETECTION OF EXCESSIVE MARKING PRESSURE

[75] Inventors: James M. Cheever, Keene; Richard H. Frye, Westmoreland; Gary F. Fowler, Keene; William E. Maxwell, Keene; Edward E. Freyenhagen, Jr., Keene, all of N.H.

[73] Assignee: Markem Corporation, Keene, N.H.

[21] Appl. No.: 56,204

[22] Filed: May 4, 1993

[51] Int. Cl.[6] ..... B41F 1/38; B41F 1/66

[52] U.S. Cl. ..... 101/291; 101/484; 101/486

[58] Field of Search ..... 101/287, 288, 101/292, 298, 316, 484, 485, 486, 291, 359–362, 293, 294, 295, 297, 299, 300, 305, 306, 317, 322, 323; 400/56, 58

[56] References Cited

U.S. PATENT DOCUMENTS

| | | | |
|---|---|---|---|
| 3,101,666 | 8/1963 | Sawtelle . | |
| 3,946,663 | 3/1976 | Engeriser | 101/245 |
| 4,163,421 | 8/1979 | Charan | 101/41 |
| 4,347,788 | 9/1982 | Dufour et al. | 101/415.1 |
| 4,387,645 | 6/1983 | Holland-Letz et al. . | |
| 4,444,108 | 4/1984 | Jenness, III . | |
| 4,596,183 | 6/1986 | Steiner et al. | 101/216 |
| 4,847,638 | 7/1989 | Moriyama | 400/56 |
| 4,881,835 | 11/1989 | Niikawa | 400/56 |
| 5,146,851 | 9/1992 | Anderson et al. . | |
| 5,201,589 | 4/1993 | Chun et al. | 400/134 |

FOREIGN PATENT DOCUMENTS

| | | |
|---|---|---|
| 63-315282 | 12/1988 | Japan . |
| 63-15281 | 12/1988 | Japan . |
| 220653 | 5/1925 | United Kingdom . |
| 1205803 | 9/1970 | United Kingdom . |
| 1528587 | 10/1978 | United Kingdom . |

OTHER PUBLICATIONS

Patent Abstracts of Japan, Section M, Section No. 814, vol. 13, No. 154, p. 49 (Apr. 14, 1989).

EDM Model HR–20 Operating Manual (not dated).

Markem Model 146A Machine Manual Dated May 1967.

Markem Model 300T Machine Manual Dated Nov. 1976.

Markem Model 4–1228 Machine Manual Dated Dec. 1977.

Markem Model U–1251M Operating Instructions (not dated).

*Primary Examiner*—J. Reed Fisher

*Attorney, Agent, or Firm*—Roylance, Abrams, Berdo & Goodman

[57] ABSTRACT

A printing apparatus employs a rotatable cam having an enclosed cam slot for controlling the rocking motion of an inking roll without the need for a cam follower spring. The apparatus also includes an articulated printing member support assembly which executes a complex curvilinear movement under the control of a fixed cam slot without the use of linear bearings. Complementary cam profiles are used on both cam surfaces in order to maintain tangency between the inking roll and printing element during inking. A yieldable connecting link is used to prevent excessive printing pressures from being applied, and a movable filler plate closes off a slot in a front cover of the printing apparatus through which a portion of the movable printing member protrudes.

33 Claims, 24 Drawing Sheets

MARKING APPARATUS WITH DETECTION OF EXCESSIVE MARKING PRESSURE

BACKGROUND OF THE INVENTION

The present invention relates generally to printing or marking apparatus, and is particularly concerned with a printing apparatus in which a reciprocating member carries a printing element that is inked by means of a rockably mounted inking roll.

Various types of printing or coding devices have been developed for printing variable information on products, product containers, or continuous webs of product wrapping material. Generally, these devices are designed for installation on existing product or web conveyor systems, container filling systems, and similar systems, and are used to print date codes, lot or batch numbers, or other types of information. The simplest type of product coding device is a rotary printer, in which a rotary die roll or type holder carries a printing element that is brought into rolling contact with the article or web surface to be printed. These devices require that the product or web be kept in motion, either continuously or during the time that the printing element is in contact with the surface to be printed. Inking of the printing element is usually carried out by mounting a rotatable inking roll in a fixed position next to the rotatable die roll or type holder.

In situations where an intermittently moving conveyor is used to transport the articles or web to be printed, as in the case where a container filling or sealing operation requires periodic stopping of the conveyor, it may be more convenient to use a reciprocating or stamping printer rather than a rotary printer. The temporary stopping of the conveyor provides an interval during which printing can be carried out by a reciprocating printing member, and inking of the printing element can occur before, during or after the printing operation by means of an inking roll or other type of inking device.

The inking of the printing element in a reciprocating printer is somewhat more difficult than in the case of a rotary printer, particularly when an inking roll is used as the inking device. In a rotary printer, the inking roll can be mounted with its axis in a fixed position with respect to the axis of the rotating printing member, and this will suffice to apply ink to the printing element by rolling contact once during each printing cycle. In a reciprocating printer, however, it is generally not possible to mount the inking roll in a fixed position relative to the path of the printing member, since this will cause ink to be applied to the printing elements twice during each printing cycle, possibly resulting in too much ink being applied. In addition, the path of movement of the reciprocating printing member may be such that it would be physically obstructed by the inking roll at some point during the printing cycle if the inking roll were to be held in a fixed position. For these reasons, it is common in reciprocating printers to mount the inking roll in a rocking or oscillating structure, so that the inking roll can be brought into rolling contact with the printing elements only once during each printing cycle and then retracted from the path of the printing member.

An additional problem that arises in reciprocating or stamping printers has to do with the fact that the printing element is usually in the form of a plane, such as a flat printing plate or several rows of type carried by a flat type holder. Clearly, if a flat printing element is to be inked by contact with a cylindrical inking roll, the printing element must move tangentially along the periphery of the inking roll (or vice-versa) during the period in which inking is taking place. During the printing interval, however, the printing member must move in a direction normal to the plane of the printing element in order to bring the printing element into contact with the surface to be printed. In order to satisfy both of these requirements, as well as the additional requirement that the printing element have ink applied to it only once during each cycle of movement of the printing member, a complex motion of either the inking roll or printing member is usually needed.

The problem of maintaining tangency between a flat printing element and an inking roll in a reciprocating printing or coding device has been addressed in the prior art. In commonly assigned U.S. Pat. No. 4,444,108, issued to Peter Jenness, III on Apr. 24, 1984 and incorporated herein by reference, the printing member moves in an arcuate path between a first position in proximity to a surface to be printed and a second position remote from the surface, under the control of a rotary crank mechanism. An inking roll assembly is mounted for rocking movement along a path which intersects the arcuate path of the printing member. The inking roll assembly is cyclically rocked in timed relation to the movement of the printing member by a cam and follower arrangement connected to the rotary crank mechanism. The cam profile is preferably chosen in such a manner as to accomplish two functions, one being to ensure that the inking roll is brought into contact with the printing element on the printing member only once during each back-and-forth cycle of movement of the printing member, and the other being to ensure that the inking roll is maintained in uniform tangential contact with the flat printing element during the interval when these two components are in physical contact.

Although the printing apparatus described in U.S. Pat. No. 4,444,108 has been commercially successful, a number of limitations exist on the reliability and performance of the apparatus. For example, two different coil springs are used in the apparatus, one operating in tension to maintain the inking roll cam follower in contact with the inking cam, and the other operating in compression as part of a resilient support means which allows the printing member to move vertically downward into contact with the surface to be printed when it is held against rotation by a stop member at a certain point during the printing cycle. Both of these springs are subject to fatigue and breakage after prolonged operation of the printing apparatus, leading to undesirable down time while the springs are replaced. The manner in which the printing member is caused to move vertically downward by the rotary crank mechanism is also somewhat disadvantageous, since at higher printing speeds the abrupt striking of the printing member against the stop member causes the operation of the printing apparatus to become uneven. As a practical matter, this limits the maximum printing speed to about 100 cycles per minute in commercial embodiments of the printing apparatus. It has also been found that the linear bearings and guide shafts which are used to guide the movement of the printing member during its vertical travel into contact with the surface to be printed are subject to wear, resulting in a slight lateral motion of the printing member during printing and consequent distortion of the printed image.

A number of other problems have also been encountered with the printing apparatus described above. For example, it is usually desirable to rock the inking roll in such a way as to initiate and withdraw contact between the inking roll and printing element rather abruptly at the leading and trailing edges of the printing element, since a more gradual rate of inking roll movement at either of these edges may result in ink being applied to (and accumulating on) the sides of the printing element or to its mounting structure. Since the speed at which the inking roll rocks toward or away from the printing element will depend upon the rate of change of the cam radius at that point, it can be readily seen that an abrupt motion of the inking roll will require a steeply ascending or descending cam profile. It is difficult to cause a cam follower to maintain contact with a cam surface in such regions unless the spring force applied to the follower arm is very high, which increases overall rotational resistance and worsens the problem of spring failure referred to previously.

A further problem with the printing apparatus of U.S. Pat. No. 4,444,108 has to do with the design of the drive mechanism that is used to move the printing member along its arcuate and linear paths. In cases where the work table supporting the article or web to be printed is adjusted too high, as often occurs inadvertently when the operator is attempting to adjust the printing pressure to ensure a suitably dark and uniform print, the rotary crank mechanism will exert too much pressure against the work table during its downward stroke. At high printing speeds, this gives rise to repeated mechanical shocks which are transmitted back through the printing member and crank mechanism to the other parts of the printing apparatus, resulting in premature wear of bearings, bushings and other components. The misadjustment of the work table is not always apparent to the operator, and hence the condition may persist for an extended period of time before it is corrected.

A variation of the printing apparatus described above is disclosed in Japanese Kokai Patent No. 63-315282. In the modified apparatus, the rotatable cam driven by the rotary crank mechanism serves only to rock the inking roll assembly between two discrete positions, one allowing contact between the inking roll and the printing elements and the other preventing such contact. A separate cam surface, in the form of a fixed cam slot disposed along the path of the printing member, is provided to control the motion of the printing member as the latter is reciprocated by the rotary crank mechanism. The fixed cam slot defines a combined arcuate and linear path for the printing member that allows for inking and vertical stamping, and also provides for tangency between the printing element and inking roll when these two components are in contact with each other. In order to allow the printing member to move both arcuately and linearly under the control of the rotary crank mechanism and fixed cam slot, and to maintain tangency with the inking roll, the printing member consists of two parts connected by linear bushings or bearings. One part is pivotably supported by the frame of the printing apparatus, and the other part (which carries the printing element) is pivotably connected to the connecting link of the rotary crank mechanism. The use of a fixed cam slot produces a somewhat smoother motion of the printing member than the resilient mounting assembly described previously, but linear bearings and guide shafts are still required to produce the combined arcuate and linear motion of the printing member under the control of the cam slot. As noted earlier, this arrangement is subject to wear and can cause distorted prints. Moreover, since the function of maintaining tangency between the inking roll and the printing element is still confined to a single component (in this case the printing member rather than the inking roll), the distances and speeds at which the component must be moved to maintain tangency are greater than might be desired. This can result in excessive dynamic loads and accelerated wear at high printing speeds, particularly when physically large and heavy printing elements are used.

SUMMARY OF THE INVENTION

In accordance with the present invention, the disadvantages and limitations associated with reciprocating printing devices of the prior art are largely avoided by incorporating a number of novel features which enhance the reliability and performance of the apparatus. One of these features resides in the use of a rotatable cam having an enclosed cam slot for controlling the rocking motion of the inking roll by means of a cam follower received in the slot. By using an enclosed cam slot rather than an external cam surface, the need for a spring to maintain the follower in contact with the cam profile is avoided. Another feature resides in the use of an articulated printing member support assembly which can be made to execute a complex curvilinear movement under the control of a fixed cam slot without the use of linear bushings or bearings. This arrangement avoids the need for both springs and linear bearings, which increases the reliability of the printing apparatus and ensures that good print quality can be maintained for a longer period of time. A third feature involves the use of complementary cam profiles on both the rotatable and fixed cams to maintain tangency between the inking roll and printing element during inking, thereby reducing the rates of component movement that occur when one cam surface carries out this function alone. This decreases the dynamic loads on the printing apparatus and increases the smoothness of its operation, leading to a decrease in wear and an increase in maximum operating speed. A fourth feature lies in the use of a yieldable link for connecting the drive source to the printing member, thereby preventing excessive printing pressures from being applied between the printing member and the surface to be printed. This not only prevents excessive forces from being transmitted throughout the printing apparatus, but also allows for the installation of a sensor to detect the reduced travel of the printing member that will occur when the link yields under excessive printing pressures, so that the condition can be brought to the attention of an operator. An additional feature of the present invention involves the use of a movable filler plate to close off a slot in the front cover of the printing apparatus through which a portion of the moving printing member protrudes. The filler plate serves as a safety feature by preventing a finger or other object from being inserted into the slot when the printing member is at its home or rest position.

In one aspect, therefore, the present invention is directed to a printing apparatus comprising a printing member arranged for reciprocating movement along a curved path between a first position in proximity to a surface to be printed and a second position remote from the surface, and a printing element carried by the printing member. A rotatable inking roll is mounted for rocking movement along a second path which brings the inking roll into contact with the printing element during reciprocating movement of the printing member along its curved path. A drive source is provided for cyclically moving the printing member in opposite directions along the curved path, and for rocking the inking roll along the second path. A first cam surface is provided for controlling the reciprocating movement of the printing member along its curved path, and a second cam surface is provided for controlling the rocking movement of the inking roll along the second path. The two cam surfaces cooperate to maintain uniform tangency between the inking roll and the printing element throughout the period of contact between these components. The present invention is also directed to a method for operating a printing apparatus in accordance with these principles.

In another aspect, the present invention is directed to an inking device for a printing apparatus of the type employing a movable printing member carrying a printing element. The inking device comprises a rotatable inking roll mounted for rocking movement to bring the inking roll into contact with the printing element during movement of the printing member, and a rotatable cam having an enclosed cam slot for controlling the rocking movement of the inking roll. A cam follower is received in the enclosed cam slot for rocking the inking roll in accordance with the profile of the cam slot, and a drive source is coupled to the rotatable cam.

In a further aspect, the present invention is directed to a marking apparatus which comprises a marking member and an articulated assembly for carrying the marking member. The articulated assembly comprises a fixed support arm defining a first axis of rotation, and a movable support arm pivotably attached to the fixed support arm about the first axis of rotation. The movable support arm defines a second axis of rotation parallel to and spaced from the first axis of rotation, and the marking member is carried by the movable support arm so as to be pivotable about the second axis of rotation. The present invention is also directed to a method for controlling the motion of a marking member to achieve a combination of rotary and linear motion, using first and second parallel, spaced-apart axes of rotation.

In a still further aspect, the present invention is directed to a marking apparatus comprising a marking member arranged for reciprocating movement into and out of contact with a surface to be marked, and a drive source for imparting reciprocating movement to the marking member. A yieldable link is provided for connecting the drive source to the marking member in order to prevent excessive marking pressure from being applied between the marking member and the surface to be printed. The present invention is also directed to a method for limiting the maximum marking pressure in a reciprocating marking apparatus, by causing a link connecting a drive source and a marking member to yield in response to a marking pressure in excess of a desired maximum marking pressure.

In a still further aspect, the present invention is directed to a marking apparatus comprising a marking member arranged for reciprocating movement into and out of contact with a surface to be printed, and a drive source for imparting reciprocating movement to the marking member. A sensor is provided for detecting a marking pressure in excess of a desired marking pressure, and a control system is coupled to the sensor and to the drive source for stopping the motion of the marking member when an excessive marking pressure is detected. A display device may also be provided for displaying an indication of excessive marking pressure to an operator. The present invention is also directed to a method for detecting an excessive marking pressure in a marking apparatus by detecting a reduced travel of the marking member when the marking member is brought into contact with a surface to be printed.

In yet another aspect of the present invention, a marking apparatus comprises an enclosure having a cover panel with a slot formed therein, and a movable marking member housed within the enclosure. The marking member includes a projecting portion that extends through the slot to the outside of the enclosure, such that the slot provides clearance for the movement of the projecting portion. A filler plate connected to the marking member and movable therewith is shaped and positioned to block at least a portion of the slot that lies in the path of the projecting portion of the movable marking member, in order to prevent a finger or other object from being inserted into the slot.

BRIEF DESCRIPTION OF THE DRAWINGS

The various objects, advantages and novel features of the invention will be more readily apprehended from the following detailed description when read in conjunction with the appended drawings, in which.

Through the drawings, like reference numerals will be understood to like parts and components.

DETAILED DESCRIPTION OF THE PREFERRED EMBODIMENT

Figure 1:
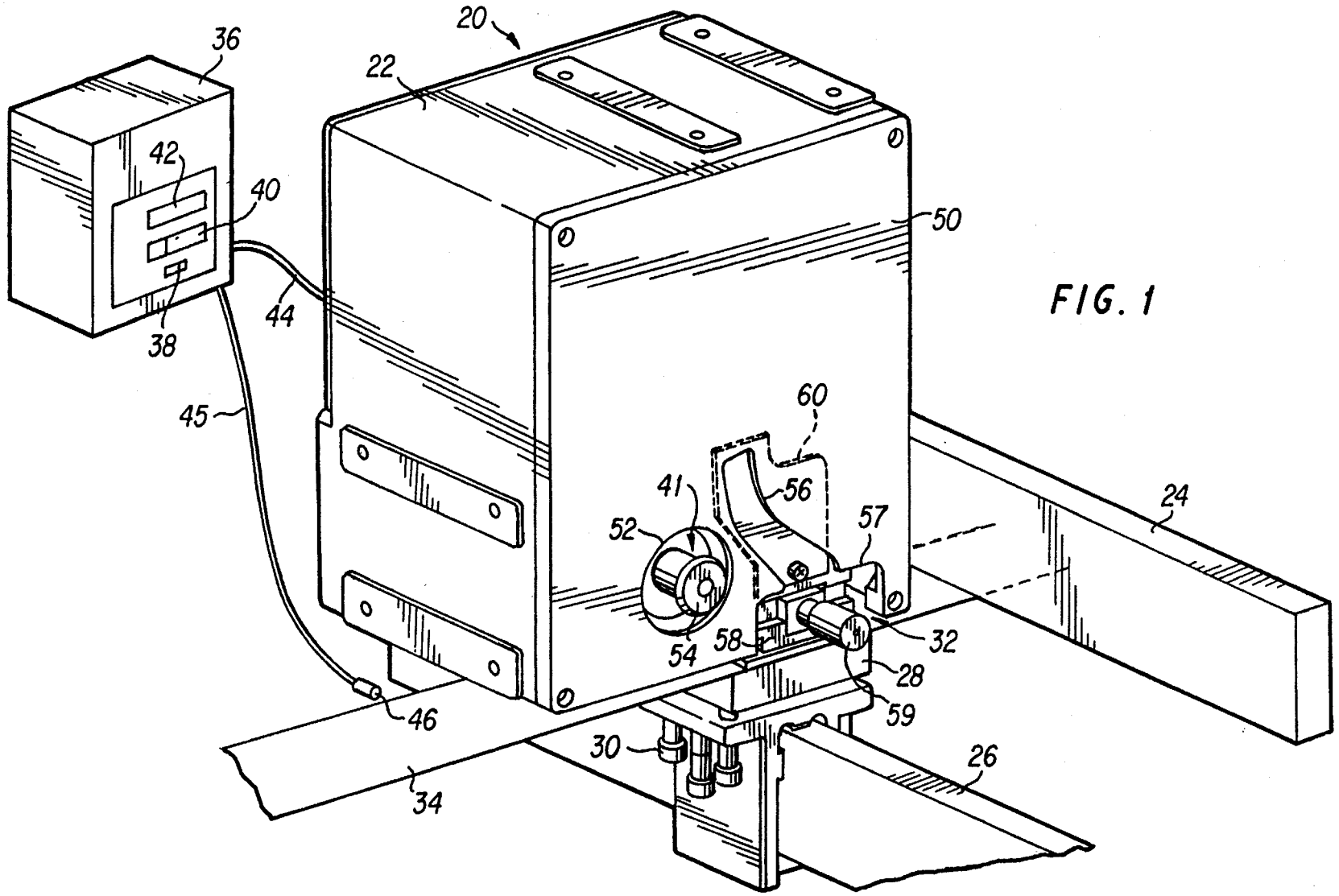
FIG. 1 is a perspective view of a reciprocating printing or marking apparatus of the type contemplated by the present invention, shown printing on an intermittently moving web or strip.

A printing apparatus 20 constructed in accordance with the present invention is illustrated in FIG. 1 in a typical operating environment. The printing apparatus 20 includes an outer enclosure 22 which is made of cast aluminum or the like, and which serves as a supporting frame for the internal components of the printing apparatus. A bracket (not visible in FIG. 1) allows the printing apparatus to be secured to a standard mounting beam 24 of rectangular cross-section, and a similar mounting beam 26 carries a work table 28 which supports the articles or web to be printed. The vertical height of the work table 28 relative to the beam 26 can be adjusted by means of adjusting screws 30, as is well known in the art. Adjustment of the work table 28 in this manner allows the printing pressure exerted by the reciprocating printing member 32 of the printing apparatus 20 to be adjusted. In FIG. 1, the printing apparatus 20 is arranged to print on a continuous web or strip 34 which passes between the work table 28 and the reciprocating printing member 32. The web 34 may, for example, comprise a strip of pre-printed wrapping material that is to be over-printed with date codes, lot or batch numbers, or some other type of variable information, before being cut and applied to the products to be wrapped. The strip is moved intermittently by a conveyor system (not shown) associated with the wrapping machine or other downstream processing apparatus, with the stopped intervals of the conveyor corresponding to the intervals during which the reciprocating printing member 32 makes contact with the web 34. It should be understood that the printing apparatus 20 can, in lieu of printing on a continuous web or strip 34, print on individual articles carried by an intermittently moving conveyor. The articles or web can also be hand-fed to the printing apparatus 20, if desired.

The printing apparatus 20 of FIG. 1 is operated by a control unit 36 which includes a membrane keypad comprising a print enable switch 38 and multifunction switches 40 which can be used to control and select among a number of different machine functions and settings. As will be described in more detail hereinafter, the printing apparatus 20 is preferably designed for use in connection with a hot-melt ink composition which is solid at normal room temperatures and is rendered liquid or flowable at elevated temperatures. The ink composition is carried by an inking roll assembly 41, and both the inking roll assembly 41 and printing member 32 are heated to maintain the ink composition in a melted state during printing. The switches 40 can, among other functions, allow the inking roll and printing member temperatures to be selected individually. The control unit 36 also includes a liquid crystal display (LCD) 42 which provides a continuous alphanumeric read-out of the inking roll and printing member temperatures, and also provides an indication of certain fault conditions such as an incomplete printing cycle. The control unit 36 is connected to the printing apparatus 20 by means of an electrical cable 44 containing power and control lines, and an additional cable (not shown) is used to connect the control unit 36 to an AC power source. A further cable 45 connects the control unit 36 to a start sensor 46, the latter being arranged to initiate operation of the printing apparatus 20 at the proper moment in order to achieve proper print registration. To this end, the start sensor 46 may be positioned adjacent to a moving portion of the web conveyor (not shown) or to the web itself. The start sensor 46 may comprise a metal-sensing device for detecting the presence of a metallic portion of the conveyor, an optical sensor for sensing a mark on the web 34 itself, or some other suitable type of sensor.

The printing apparatus 20 includes a removable front cover plate 50 that is secured to the enclosure or frame 22 to prevent operator contact with the internal components of the printing apparatus. The cover plate 50 includes a circular hole 52 which is of sufficient diameter to allow removal and replacement of the inking roll assembly 41 (via a protruding handle 54) without the need to remove the cover plate 50 from the printing apparatus. The cover plate 50 also includes a curved slot 56 which lies generally along the path of reciprocating movement of the printing member 32, the latter being shown in the home or rest position in FIG. 1. The slot 56 communicates with a somewhat larger opening 57 formed at the bottom edge of the cover plate 50, and this opening allows the type holder 58 carried by the printing member 32 to be removed from the printing apparatus 20 by means of a handle 59 which protrudes outwardly beyond the plane of the cover plate 50 in the same manner as the handle 54 of the inking roll. The slot 56 provides clearance for the movement of the handle 59 of the type holder 58 as the printing member 32 reciprocates upwardly and downwardly during a printing cycle. A filler plate 60, whose outlines are indicated in dashed or hidden lines in FIG. 1, is carried by the reciprocating printing member 32 along the interior surface of the cover plate 50 and closes off the region of the slot 56 above the handle 59 while the printing member 32 is in the home or rest position as shown, thereby preventing the insertion of a finger or other object into the slot 56. It will be apparent that the area of the printing apparatus immediately below the reciprocating printing member 32 is open in order to allow the downwardly facing printing elements (not shown) carried by the type holder 58 to be brought into contact with the web or strip 34 during printing.

Figure 2:
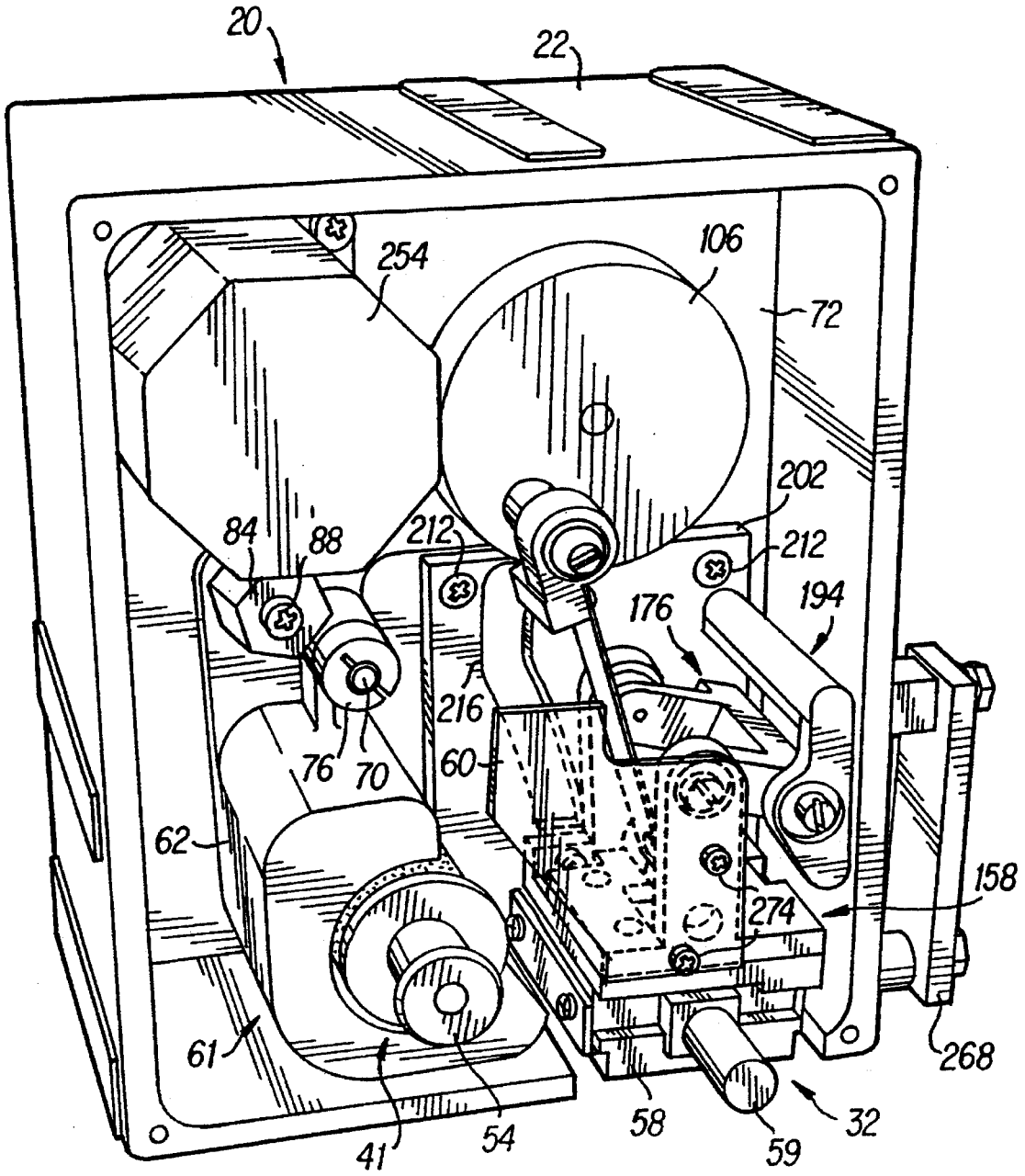
FIG. 2 is a front perspective view of the printing apparatus, with a front cover panel removed to illustrate certain internal components.
Figure 3:
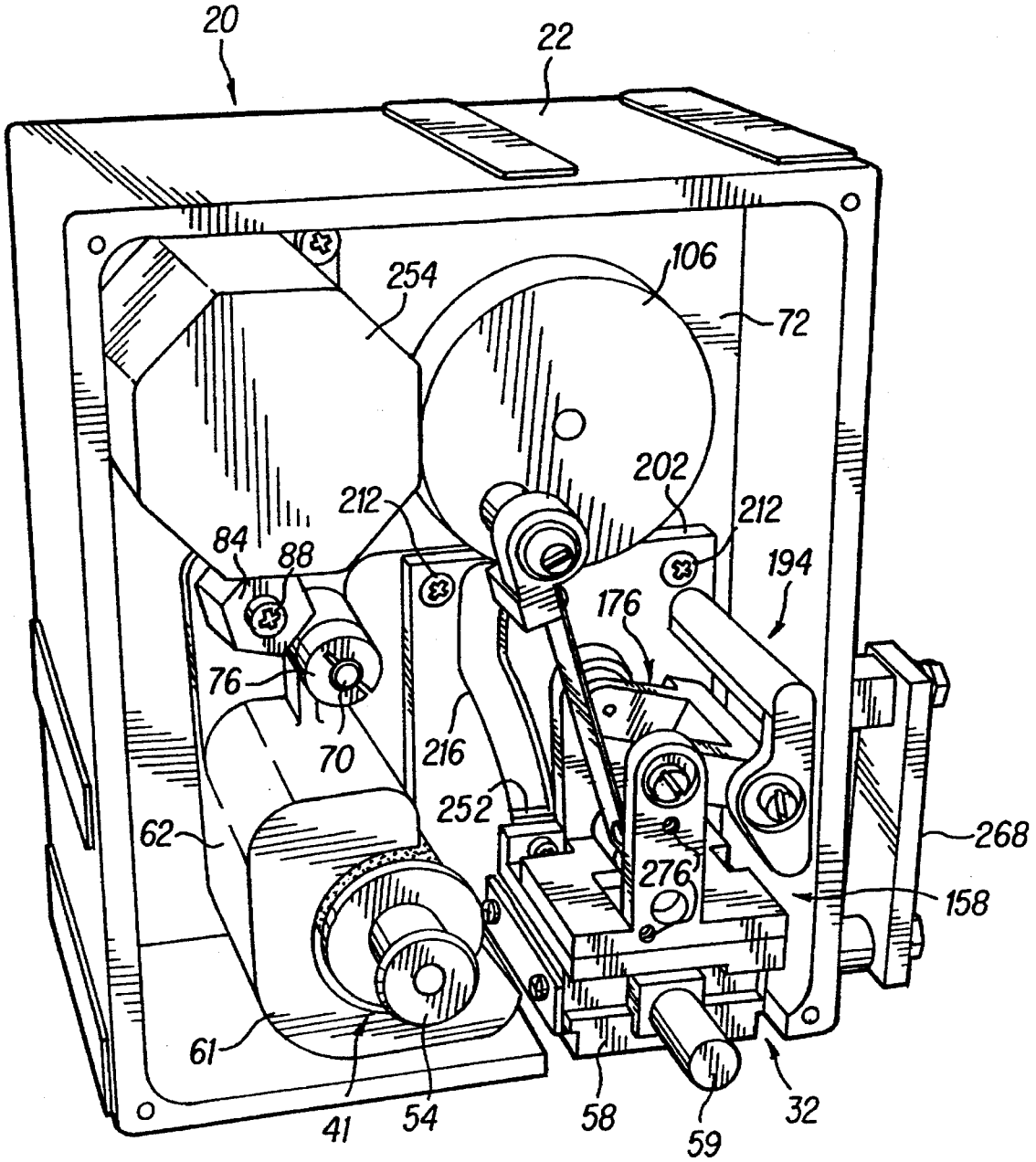
FIG. 3 is a front perspective view of the printing apparatus similar to FIG. 2, but with a filler plate carried by the printing member removed to illustrate additional details of the printing apparatus.

In FIGS. 2 and 3, the printing apparatus 20 is illustrated with the control unit 36, mounting beams 24 and 26, work table 28 and web 34 deleted for clarity. In addition, the front cover plate 50 of the enclosure 22 has been removed in both views to illustrate the internal components of the printing apparatus 20, and the filler plate 60 has also been removed in FIG. 3 to illustrate certain details which are obscured by this component in FIG. 2. The inking roll mounting assembly 61, which carries the inking roll assembly 41, is a rockable structure with a lower housing 62 made of a heat-resistant plastic. The housing 62, which is shown in more detail in the exploded view of FIG. 4, contains an internal metal heater block 64 which is preferably made from a solid block of aluminum with holes 67 for receiving a number of cartridge-type electrical heating elements 69 and a thermistor 73. Similar holes 71 are formed at corresponding positions in the housing 62 to allow for removal of the heating elements 69 and thermistor 73. The heater block 64 has a cylindrical interior surface 65 which is separated by a narrow gap from the exterior of the inking roll assembly 41, and serves to maintain the ink composition in the inking roll at an elevated temperature for printing.

Figure 4:
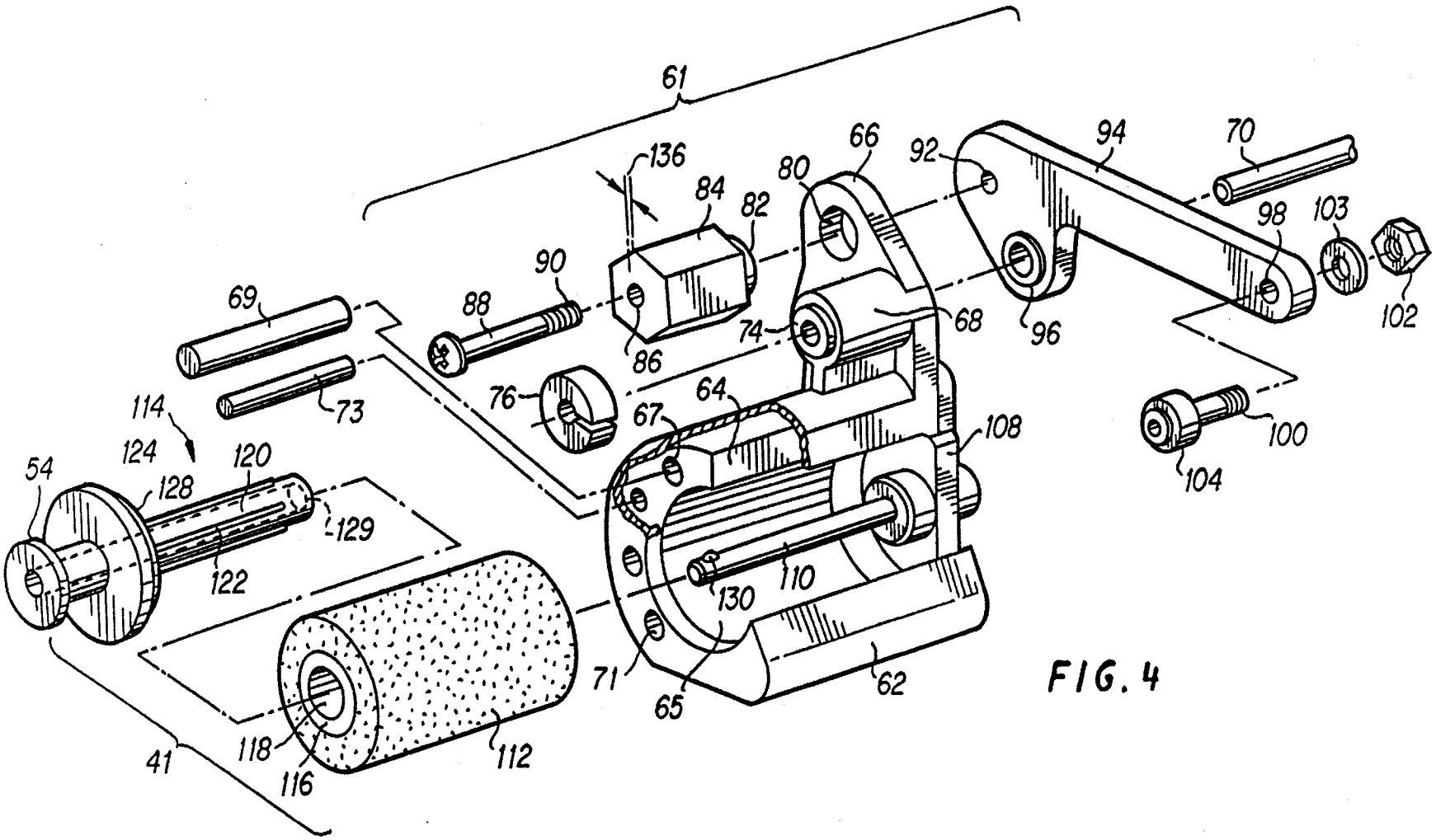
FIG. 4 is an exploded perspective view of the rockable inking assembly used in the printing apparatus of FIG. 2.

The housing 62 is formed with an upper extension 66 which includes a raised cylindrical boss 68. As best seen in FIG. 4, a fixed shaft 70 that is mounted to the rear wall 72 of the printing apparatus frame 22 passes through a bearing 74 in the boss 68 and is clamped by a collar 76. In this way, the housing 62 and inking roll assembly 41 are allowed to pivot or rock as a unit with respect to the fixed shaft 70. The upper end of the extension 66 is provided with a slightly elongated hole or slot 80 which receives a cylindrical boss 82 formed on an eccentric adjustment device 84. The adjustment device 84 is provided with a longitudinal hole or bore 86 which is dimensioned to receive a retaining screw 88. In the assembled condition of the inking roll mounting assembly 61, the retaining screw 88 passes through the hole 86 in the adjustment device 84, and its threaded portion 90 engages a threaded hole 92 formed at the end of a follower arm 94. The follower arm 94, which forms the upper portion of the inking roll mounting assembly 61, is thereby coupled to the housing 62 so as to be rockable or pivotable therewith. The follower arm 94 is formed with an additional hole below and to the right of the hole 92 in FIG. 4 for receiving a bearing 96. The bearing 96 receives the fixed pivot shaft 70 so that the follower arm 94 and housing 62 can rock or pivot as a unit about the axis of the shaft 70. The follower arm 94 is formed with a further hole 98 which receives the shaft 100 of a rotatable cam follower 104. The threaded part of the shaft 100 passes through the hole 98 and is engaged by a hex nut 102 and washer 103 on the rear face of the follower arm 94. The cam follower 104 is received in an enclosed (i.e., two-sided) slot 105 formed in the rear surface of a rotatable inking cam 106 (shown in FIGS. 2, 3, 5 and 8) in order to rock the entire inking assembly 61 in synchronism with motion of the printing member 32, as will be described hereinafter.

The lower housing portion 62 of the inking assembly 61 is formed with a rear wall 108 which carries a fixed inking roll shaft 110. The shaft 110 carries the inking roll assembly 41, which comprises a porous foam inking roll 112 mounted on a hub or arbor 114. The inking roll 112 is impregnated with a pigmented thermoplastic ink composition of the type which is solid at normal room temperatures, so that the inking roll can be conveniently handled and stored, but is rendered liquid or flowable at elevated temperatures of about 250° to 300° F. for printing. Upon contact with the surface to be printed, the ink cools and solidifies so that the printed image can be handled immediately or subjected to further processing without the risk of smearing. Inking rolls of this type are sold by Markem Corporation of Keene, New Hampshire, the assignee of the present invention, under the brand names TOUCH-DRY and TOUCH-DRY PLUS. In the manufacture of the inking roll, the porous foam body 112 is impregnated with the ink composition only down to a certain depth, leaving an annular non-impregnated region 116 of resilient foam adjoining an axial hole or bore 118. The hub or arbor 114 carries the porous foam roll 112 and allows the inking roll assembly 41 as a whole to be rotatably mounted on the fixed inking roll shaft 110. The hub 114 is made of a heat-resistant plastic material and includes an elongated tubular portion 120 with integral ribs or grips 122. The tubular portion 120 is dimensioned so that it can be frictionally received in the hole or bore 118 of the foam ink roll 112, compressing the non-impregnated foam region 116 somewhat as it is inserted. A stepped disk or flange 124 having a diameter approximately equal to that of the inking roll 112 prevents heat loss through the end of the inking roll 112 when the inking roll assembly 41 is installed in the housing 62, and the handle portion 54 allows the inking roll assembly 41 to be inserted and removed from the housing 62 when replacement of the inking roll 112 is needed. The inner stepped portion 128 of the disk or flange 124 makes contact with the non-impregnated portion of the inking roll 112, thereby preventing direct contact between the impregnated portion of the inking roll and the outer portion of the flange 124. This facilitates removal of the hub 114 from the inking roll 112 during inking roll replacement, by preventing ink in the impregnated portion of the inking roll from adhering to the outer portion of the flange 124. When the inking roll assembly 41 is installed in the housing 62, the axial bore 129 in the tubular portion 120 of the hub 114 is received over the fixed inking roll shaft 110. The fit between the shaft 110 and the bore 129 is sufficiently loose to allow the inking roll assembly 41 to turn on the shaft 110 when it is brought into rolling contact with the printing elements on the moving printing member 32. The inking roll shaft 110 is provided with a resilient ball detent 130 which serves to retain the inking roll assembly 41 on the shaft 110, by engaging an internal relieved or counterbored region (not shown) of the bore 129. With the inking roll assembly in the installed position within the housing 62, a narrow gap is maintained between the heater block surface 65 and the exterior surface of the inking roll 112 in order to promote effective heating of the inking roll.

With continued reference to FIGS. 2, 3 and 4, the eccentric adjustment device 84 allows the pressure exerted by the inking roll 112 on the printing elements carried by the type holder 58 to be adjusted. The manner in which this is accomplished can best be understood by reference to FIG. 4. As noted previously, the lower housing portion 62 and upper follower arm portion 94 of the rockable inking assembly 61 are held in a fixed relationship to each other by the adjustment screw 88 and eccentric device 84. In this condition, there is a fixed angle between the line connecting the axes of the pivot shaft 70 and cam follower shaft 100, and the line connecting the axes of the pivot shaft 70 and inking roll shaft 110. As the cam follower 104 is moved upwardly by the inking roll cam 106 to rock the inking assembly 61, as will be described hereinafter, the angle between these lines will determine how far the resilient surface of the inking roll 112 extends into the path of the printing member 32 and hence the amount of pressure exerted by the inking roll 112 against the printing elements carried by the type holder 58. In order to adjust this angle, the adjustment screw 88 is loosened and the eccentric adjustment device 84 is turned in a clockwise or counter-clockwise direction. As shown in FIG. 4, the hole 86 in the adjustment device 84 is offset with respect to the axis of the cylindrical boss 82 by a small distance 136, and hence rotation of the adjustment device 84 will have the effect of rotating the housing 62 and follower arm 94 with respect to each other about the shaft 70. This will vary the angle between the two lines referred to previously, thereby increasing or decreasing the pressure exerted by the inking roll 112 against the printing elements during inking. The eccentric adjustment device 84 is preferably provided with a hexagonal shape, as shown, so that it may be grasped with a socket wrench or other suitable tool in order to effect this adjustment.

Figure 5:
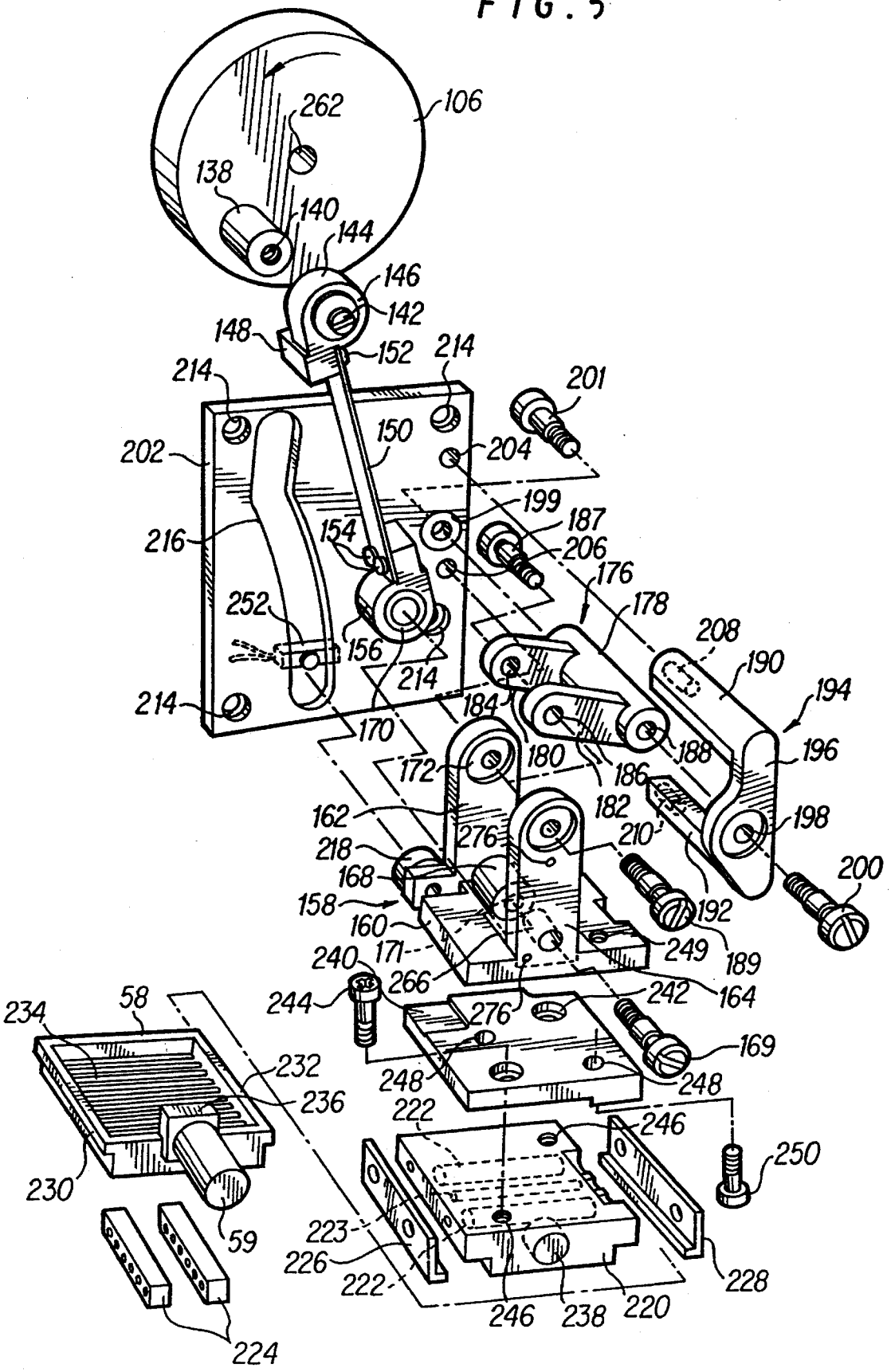
FIG. 5 is an exploded perspective view of the reciprocating printing member used in the printing apparatus of FIG. 2, together with certain related drive components.

With further reference to FIGS. 2 and 3, and also with reference to the exploded view of the printing member 32 provided in FIG. 5, the reciprocating printing member 32 is driven by the same rotatable cam 106 that causes the rocking motion of the inking roll mounting assembly 61. The front surface of the cam 106 carries a raised boss 138 which is formed with a threaded hole or bore 140. A shoulder screw 142 passes through a connecting link pivot 144 and engages the hole 140 in order to attach the connecting link pivot 144 to the boss 138 and cam 106. The connecting link pivot 144 includes two internal bearings (one of which is indicated at 146) to allow the outer portion of the connecting link to rotate with respect to the shoulder screw 142 and boss 138. The connecting link pivot 144 includes a lower extension 148 which is affixed to a connecting link 150 by means of a pair of screws, one of which is shown at 152. The connecting link 150 is made of a resilient yieldable material, such as a 0.020-inch thick strip of blue spring steel which is about 2.5 inches long and 1.0 inch wide, for a purpose to be described shortly. As can be seen in FIG. 5, the lower end of the connecting link 150 is attached by means of a further pair of screws 154 to a lower connecting link pivot 156 which is similar in construction to the upper connecting link pivot 144. The lower connecting link pivot 156 is rotatably connected to a heater block holder 158 which forms a part of the reciprocating printing member 32. The heater block holder 58 is generally in the form of a horizontal rectangular platform 160 with a pair of spaced vertical arms 162 and 164. The lower connecting link pivot 152 is received in a rectangular hole 166 formed in the horizontal platform 160, and is retained between the inner surface of the forward vertical arm 164 and the confronting surface of a boss 168 formed on the inside surface of the rear vertical arm 162 by means of a shoulder screw 169 which engages a threaded hole 171 in the boss 168. The bearings carried by the lower connecting link pivot 156, one of which is indicated at 170, allow the heater block holder 158 to pivot freely with respect to the lower connecting link pivot 156. At the upper ends of the arms 162 and 164, circular bores are formed to receive a pair of bearings 172 and 174. These bearings allow the heater block holder 158 to pivot with respect to a pivot block 176 which forms a part of an articulated supporting structure for the printing member 32. The pivot block 176 includes a cylindrical portion 178 and a pair of projecting arms 180 and 182 which are formed with aligned threaded holes or bores 184 and 186 near their ends. The arms 180 and 182 are dimensioned to be received between the inner faces of the bearings 172 and 174 of the heater block holder 158, and shoulder screws 187 and 189 pass through the bearings 172, 174 and the holes 184, 186 in order to establish a pivotable connection between the heater block holder 156 and pivot block 176. The cylindrical portion 178 of the pivot block 176 is formed with a threaded longitudinal bore 188 whose axis is parallel to the axis defined by the holes 184 and 186. The cylindrical portion 178 is received between the rearwardly extending upper and lower arms 190 and 192 of a support bar 194. The arms 190 and 192 are held in spaced-apart relation by a forward connecting portion 196 of the support bar 194. A circular bore is formed through an enlarged area of the connecting portion 196 to receive a bearing 198, and an additional bearing 199 is received in a bore formed through a fixed cam plate 202. Shoulder screws 200 and 201 pass through the bearings 198 and 199, and engages threaded bore 188 in the cylindrical portion 178 of the pivot block 176. The support bar 194 itself is affixed to the cam plate 102 by means of screws (not shown) which extend through holes 204 and 206 in the cam plate 202 to engage threaded holes 208 and 210 formed longitudinally through the arms 190 and 192. As a result of this arrangement, the support bar 194 is fixed relative to the cam plate 202 and defines a fixed axis of rotation which corresponds to the axis of the bore 188 formed in the cylindrical portion 178 of the pivot block 176. The pivot block 176 is pivotable as a whole about this axis, and hence the second axis defined by the aligned holes 184 and 186 in the arms 180 and 182 of the pivot block 176 also pivots relative to the first axis. This second axis forms the pivot axis of the heater block holder 158 as described previously. The heater block 158 is thus capable of pivoting about two parallel, spaced-apart axes, one axis defined by the axis of the bore 188 and the second axis defined by the aligned axes of the holes 184 and 186. The two pivot axes allow the heater block holder 158, and the other parts of the printing member 32 to which it is affixed, to execute a complex arcuate and linear motion as will be described hereinafter.

As will be apparent from FIG. 5, the support bar 194 serves as the mounting point for the printing member 32 (via the pivoting support block 176) on the fixed cam plate 202. The cam plate 202, in turn, is affixed to the rear wall 72 of the printing apparatus frame 22 by means of screws 212 (visible in FIGS. 2 and 3) which pass through holes 214 formed in the cam plate 202. Thus, the cam plate 202 serves as a subframe for carrying the movable printing member 32 and the articulated support assembly formed by the pivot block 176, support arm 194 and the pivoting connections therebetween.

The cam plate 202 is formed with a generally vertical cam slot 216 which controls the motion and orientation of the movable printing member 32 during successive printing cycles. A rotatable cam follower 218 is connected to the heater block holder 158 at the rear edge of the horizontal platform 160, and is positioned so that it is received in the cam slot 216. The cam slot 216 is slightly wider than the diameter of the cam follower 218 (preferably by about 0.001 to 0.002 inch) so that the cam follower 218 can rotate freely in the slot 216 without being in contact with both sides of the slot at the same time. The cam follower 218 moves upwardly and downwardly in the slot 216 during reciprocation of the printing member 32, with such reciprocation being caused by rotation of the cam 106. In the preferred embodiment, the cam 106 rotates in a counter-clockwise direction as shown, although it will be understood that clockwise rotation of the cam 106 is also possible. When the cam 106 rotates, the upper connecting link pivot 144 executes a vertically reciprocating motion which is transmitted through the connecting link 150 to the lower connection link pivot 156 and hence to the movable printing member 32. The cam 106 and upper connecting link pivot 144 thereby serve as a rotary crank mechanism for reciprocating the printing member 32. As the connecting link 150 urges the printing member 32 upwardly and downwardly, the cam follower 218 (whose axis is offset from the two pivot axes of the articulated support assembly) and cam slot 216 cause the printing member 32 to follow a complex curvilinear path as will be described hereinafter. The position and orientation of the printing member 32 at each point along this path will be defined by the shape of the cam slot 216, and will generally consist of a pivoting or rotational motion to carry the printing member past the inking roll assembly 41 and a linear motion to bring the printing member 32 into contact with the surface to be printed. The pivoting motion includes a controlled portion during which the cam slot 216 maintains the printing elements carried by the printing member 32 in uniform tangential contact with the surface of the inking roll 112, and the enclosed slot 105 of the cam 106 also contributes to this tangency function by moving the inking roll mounting assembly 61 in a complementary manner. The profiles of the cam slots 105 and 216 which are used to accomplish these functions will be described in more detail shortly.

With continued reference to FIG. 5, the printing member 32 includes a metal heater block 220 which is preferably made from a solid block of aluminum or other metallic or non-metallic material of suitable thermal conductivity. The heater block 220 is formed with holes or bores for receiving cartridge-type electrical heating elements 222 and thermistor 223. Electrical connections are established to the heating elements 222 and thermistor 223 by means of wires (not shown) which extend from the heater block 220 to the interior of the printing apparatus 20 behind the rear wall 72 (shown in FIGS. 2 and 3). Sufficient play is provided in these wires to allow for free movement of the printing member 32. The purpose of the heater block 220 is to raise the temperature of the printing elements 224 carried by the type holder 58, so that ink that has been applied to the printing elements 224 by the inking roll 112 is maintained in a fluid or melted state until it is applied to the surface to be printed. A pair of L-shaped gibs or rails 226 and 228 are attached by screws (not shown) to the sides of the heater block 220, in order to define tracks for slidably receiving the type holder 58 by means of longitudinal ribs 230 and 232 formed along the sides of the type holder. The printing elements 224 are slipped over metal pins 234 which are carried by the type holder 58. The pins 234 are mounted in a cantilevered manner with their free ends at the right-hand side in FIG. 5, thereby allowing the printing elements to be slipped over the pins from one end. (If clockwise motion of the cam 106 is desired, the free ends of the pins 234 will preferably extend to the left in FIG. 5 so that the printing elements 224 will not be pushed off the pins by repeated contact with the inking roll 112). When the type holder is inserted between the gibs 226 and 228 of the heater block 220, the upper (non-printing) faces of the printing elements 224 are held close to or in contact with the lower face of the heater block 220 in order to receive heat therefrom by conduction and/or radiation. The printing elements may comprise individual brass, rubber or brass-bodied rubber type characters, individual lines of brass, rubber or brass-bodied rubber type, or printing plates made of brass, rubber or plastic materials. Heating of the printing elements by the heater block 220 is most efficient when metallic printing elements are used, but some degree of conductive and radiant heating will occur even when the printing elements are made in whole or in part from non-metallic materials. In order to retain the type holder 58 in position with respect to the heater block 220, a magnetically attractable screw (not shown) is molded into the base portion of the handle 59 with its head face exposed. The screw head is attracted by a magnet 238 which is received in a circular cavity at the forward edge of the heater block 220. Magnetic retention of the type holder 58 on the heater block 220 provides a convenient quick-release function which prevents the type holder 58 from becoming dislodged from the heater block 220 during operation of the printing apparatus 20.

The heater block 220 is affixed to the bottom face of the horizontal platform 160 of the heater block holder by means of an insulating spacer 240. The insulating spacer 240 is provided with two diagonally opposed vertical holes 242 which are counter-bored from the top to receive a pair of metal screws, one of which is shown at 244 in FIG. 5. The screws 244 pass through the holes 242 and are received in threaded holes 246 formed through the top surface of the heater block 220. The counter-bored areas of the holes 242 are sufficient in size to receive the heads of the metal screws 244, in order to prevent heat conduction from the heater block 220 to the metal heater block holder 158 through the screws. In a similar manner, a second pair of diagonally opposed vertical holes 248 are formed through the insulating spacer 240, and these holes are counterbored from the bottom surface of the spacer 240. A second pair of metal screws, one of which is shown at 250 in FIG. 5, pass through the holes 248 and engage corresponding holes 249 formed through the horizontal platform 160 of the heater block holder 158. The counter-bored regions of the holes 248, which are on the lower surface of the spacer 240 and hence are not visible in FIG. 5, are sufficient in size to receive the heads of the screws 250. Thus, heat conduction between the heater block 220 and heater block holder 158 via the metal screws 250 is prevented.

In order to promote radiant heating of the printing elements 224 by the heater block 220 (in addition to the heating which takes place by thermal conduction), the surface of the heater block 220 is preferably provided with a high-emissivity coating having a dark color. Such a coating may, for example, consist of a black anodized hard coat layer of aluminum oxide formed on the outside surfaces of the heater block 220. Dark surface coatings of other types may also be used, such as black paint, but hard coat anodized coatings are preferred since they are durable, easy to clean and resistant to abrasion from the printing elements 224. The inking roll heater block 64 of FIG. 4 is also preferably provided with a black anodized coating in order to promote radiant heating of the inking in roll 112, but this coating need not be of the hard coat type since the inking roll heater block 64 experiences less abrasion than the printing member heater block 220.

The type holder 58 illustrated in FIG. 5 is one of two different types of type holders which may be used in connection with the printing apparatus 20. The illustrated type holder 58, which may be referred to as a radial type holder, has the type-holding pins 234 extending from side to side when the printing apparatus 20 is viewed from the front. In some cases, however, it may be desired to print on articles or surfaces in such a manner that the printed characters read from front to back (or back to front) when the printing apparatus 20 is viewed from the front. In these situations, a modified type holder (not shown) may be employed in which the pins 234 extend from front to back rather than from side to side. The modified type holder, which may be referred to as an axial type holder, has an external configuration similar to that of the type holder 58 so that it can be received between the gibs 226 and 228 of the heater block 220.

In order to allow the operation of the printing apparatus 20 to be controlled by means of an electrical control system, a sensor 252 (which may comprise a proximity detector) is disposed immediately behind the cam plate 202 at a position near the bottom of the cam slot 216. The position of the sensor 252 is such that it will detect the cam follower 218 at a point somewhat above the lowest point reached by the cam follower 218 in the slot 216 during the printing cycle. In other words, as the cam follower 218 moves downwardly in the cam slot 216, the sensor 252 first detects and then does not detect the cam follower 218, and the same sequence of events is repeated in reverse during the upward travel of the cam follower 218. The sensor 252 serves two functions, one being to establish a home or rest position of the printing member 32, and the other being to detect an excessive printing pressure. These functions, which can be carried out by two different sensors if desired, will be discussed in more detail hereinafter.

Figure 6:
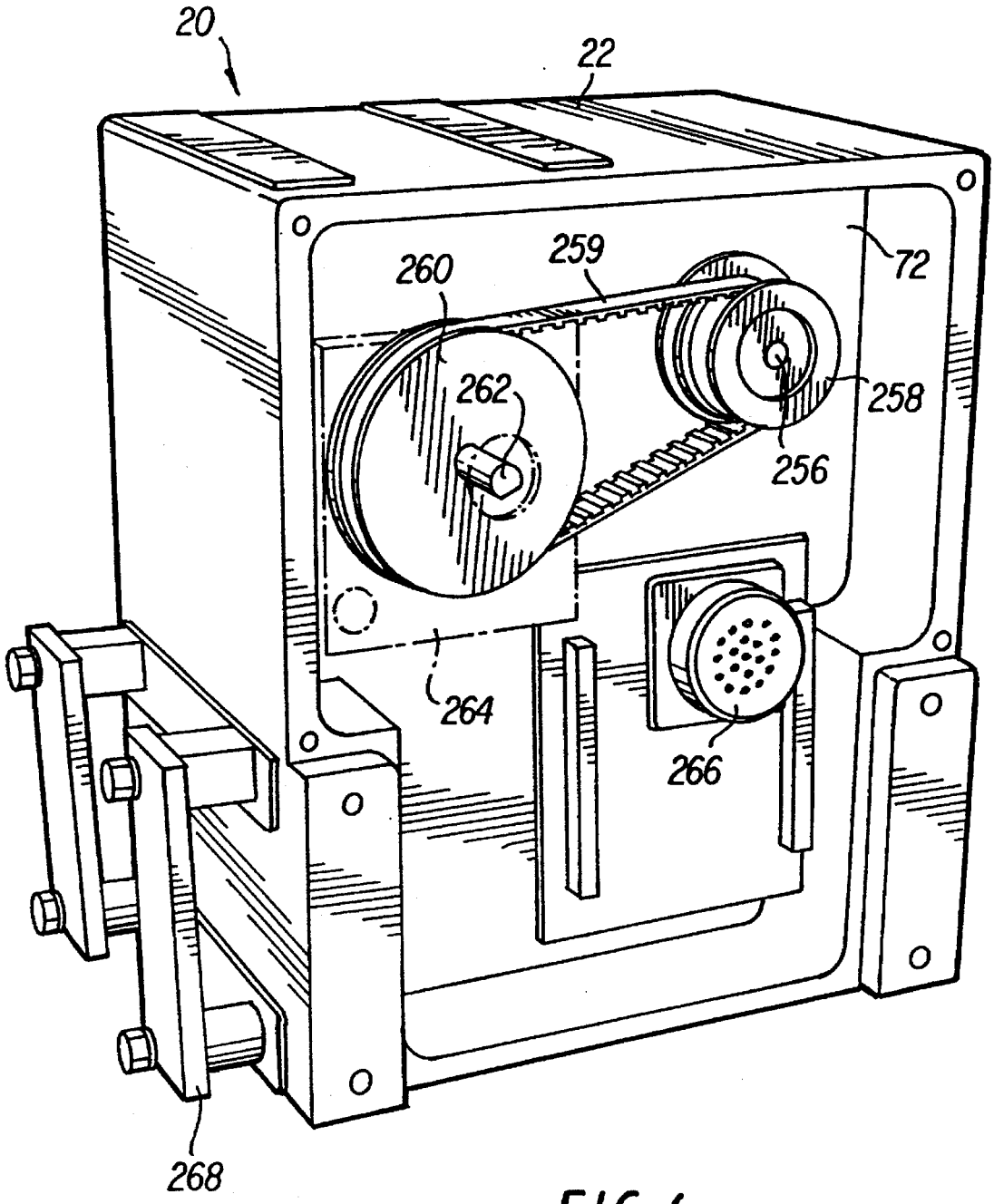
FIG. 6 is a rear perspective view of the printing apparatus of FIG. 2, with a rear cover plate removed to illustrate certain details of the drive system.

Referring now to FIG. 6, the printing apparatus 20 is shown in a rear view with a rear cover plate removed. A stepping motor 254 (visible in FIGS. 2 and 3) is mounted to the front surface of the vertical wall 72 of the printing apparatus. The motor shaft 256 passes through an aperture in the wall and is affixed to a timing belt pulley 258 which is visible in FIG. 6. The timing belt pulley 258 drives a somewhat larger timing belt pulley 260 by means of a timing belt 259. The pulley 260 is received between a bearing plate 264 and the wall 72 of the printing apparatus. The shaft 262 of the pulley 260 is carried by bearings in the bearing plate 264 and wall 72, and extends forwardly through the wall 72 to rotate the cam 106 of FIGS. 2, 3 and 5. Thus, the stepping motor 254 of FIGS. 2 and 3 serves as the drive source for the reciprocating printing member 32 and also for the rocking ink roll mounting assembly 61. Also visible in FIG. 6 is an electrical connector 266 for establishing electrical connections to the heating elements and thermistors installed in the heater blocks 64 and 220, and to the sensor 252. The electrical cable 44 shown in FIG. 1 extends between the connector 266 and the control unit 36. FIG. 6 also illustrates a mounting bracket 268 of conventional type which is used to mount the printing apparatus 20 on the beam 24 of FIG. 1.

Figure 7:
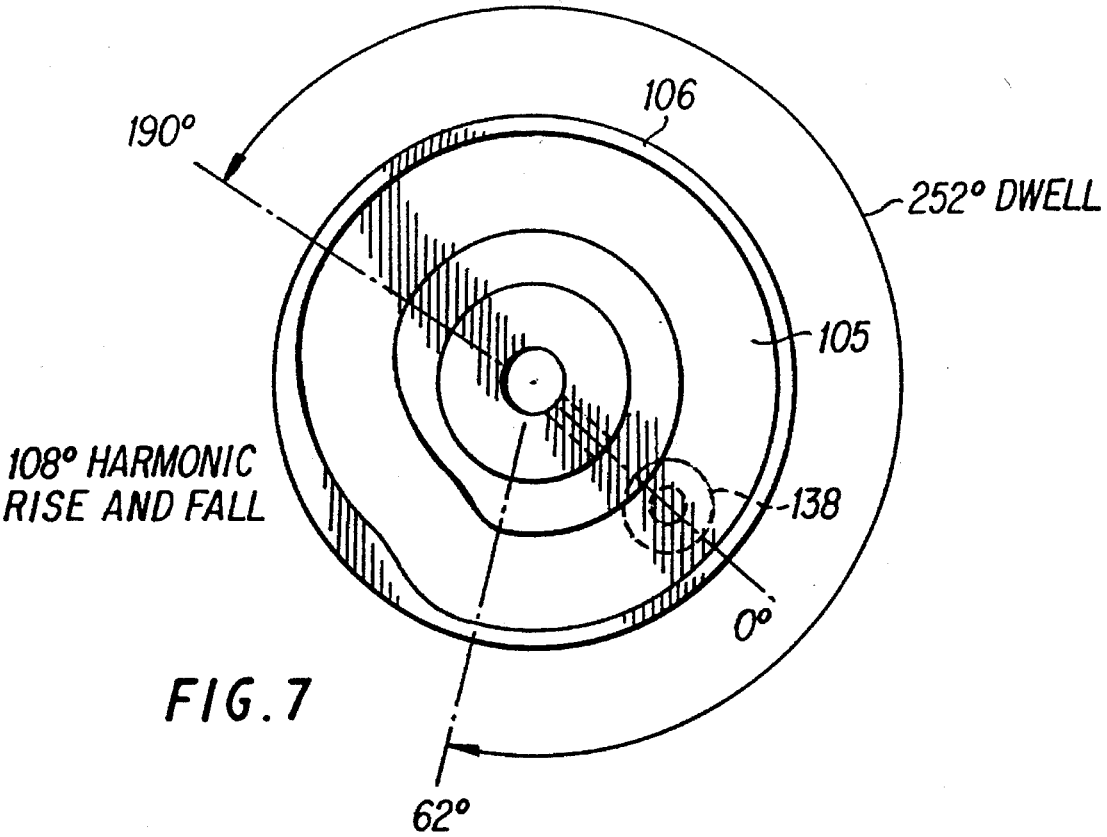
FIG. 7 is a rear view of the rotatable inking cam used in the printing apparatus of FIG. 2, illustrating the enclosed cam slot.

FIG. 7 is a rear view of the inking cam 106, illustrating the internal cam slot 105 which receives the cam follower 104 of FIG. 4. The profile of the cam slot 105 is selected so as to accomplish two functions, one of which is to rock the inking roll mounting assembly 61 inwardly (i.e., toward the right in FIGS. 2 and 3) in order to bring the inking roll 112 into contact with the printing elements carried by the printing member 32 only once during the printing cycle, and the second function being to maintain tangency between the planar printing elements 224 and the surface of the inking roll 112 throughout the period of contact. With regard to the first function, this is accomplished in the preferred embodiment by bringing the inking roll 112 into contact with the printing elements only during the downward stroke of the printing member 32; however, this is not essential and the printing elements may be inked on the upward stroke of the printing member 32 if desired, although this may require the use of a modified type holder 58 as described previously. In FIG. 7, the radial line from the central axis of the cam to the axis of the cylindrical boss 138 has been taken as the 0° reference. The cam slot 105 has a constant radius through about 190° in the counter-clockwise direction from the 0° point, and also has a constant radius through about 62° in the clockwise direction. Thus, the cam slot defines a dwell interval of approximately 252° during which there will be no vertical motion of the cam follower 104. During this period, the inking roll mounting assembly 61 remains in the retracted position shown in FIGS. 2 and 3, so that the inking roll 112 is held out of contact with the printing elements carried by the printing member 32. During the remaining 108° of the cam rotation, the cam profile falls through 63° and rises through 45° in a harmonic manner to bring the inking roll 112 into contact with the printing elements 224, to maintain uniform tangential contact between the inking roll and the planar printing elements, and to return the inking roll mounting assembly 61 to the retracted position after inking is complete. This is accomplished by choosing the cam profile so that the inking roll 112 moves progressively closer to the innermost pivot axis of the printing member 32 (i.e., the pivot axis defined by the axes of the aligned holes 184 and 186 in FIG. 5) as the line of contact between the inking roll and printing elements moves away from the leading edge of the printing elements, and so that the inking roll 112 moves progressively farther away from this axis as the line of contact between the inking roll and printing elements moves toward the trailing edge of the printing elements. It will be apparent that, if a single flat printing plate is used as the printing element, the leading and trailing edges of the printing element will correspond to those of the printing plate as a whole. If a plurality of individual printing elements (such as type characters or lines of type) are used, the leading and trailing edges will be those of the entire planar area or region occupied by the printing elements. In the arrangement illustrated in FIG. 5, this planar area will correspond to the rectangular area occupied by the type holding pins 234. The desired harmonic rise and fall of the inking roll cam profile is described by the following equation:

$$A=\frac{B}{2}\left(1\pm\mathrm{Cos}\left(\frac{\pi C}{D}\right)\right)$$

where

A is equal to the angular displacement of the inking roll mounting assembly 61 at the cam angle C, B is equal to the total angular displacement of the inking roll assembly 61 which is needed to move the inking roll axis between its two extreme positions, C is the angular position of the cam 106, and D is the total angular motion of the cam 106 through which the harmonic rise or fall will take place (i.e., 63° or 45° in the preferred embodiment). The plus sign is used when harmonic fall is desired, and the minus sign is used for a harmonic rise.

Figure 8:
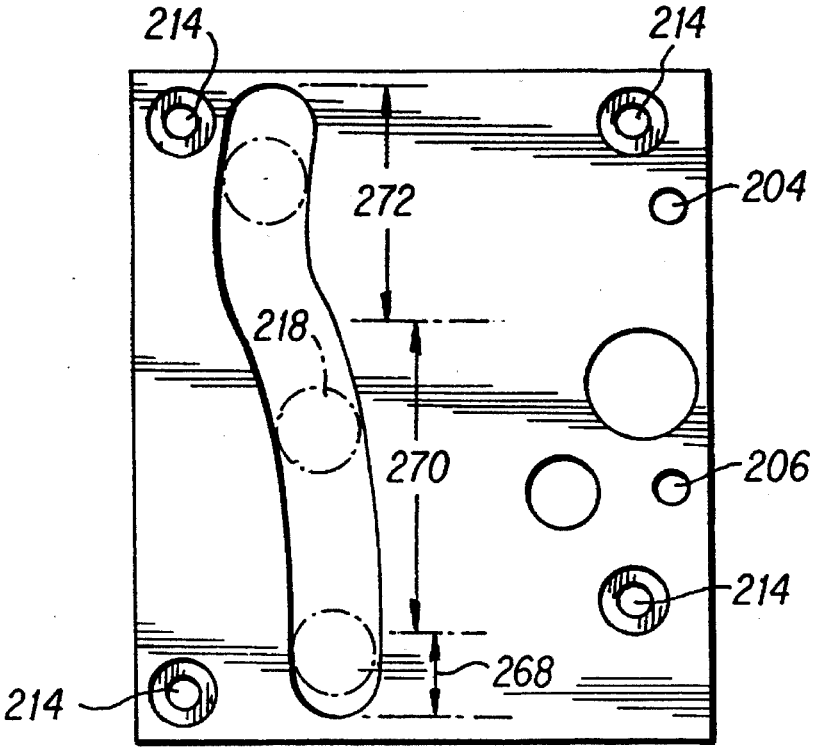
FIG. 8 is a front view of the fixed cam plate used in the printing apparatus of FIG. 2, illustrating the cam slot which controls the motion of the printing member.

FIG. 8 is a front view of the cam plate 202, illustrating the profile of the fixed cam slot 216. The cam slot 216 receives the follower 218 carried by the printing member 32, and controls the motion and orientation of the printing member 32 throughout the printing cycle. In general, the cam slot 216 includes a short lower segment 268 which is substantially vertical, an intermediate segment 270 which curves progressively in the left-hand direction in FIG. 8, and an upper segment which curves left and then slightly to the right. The lower segment 268 causes a substantially vertical or translational movement of the printing member 32 which brings the printing elements into contact with the surface to be printed, and which withdraws the printing elements from contact with the printed surface following printing. The curvature of the intermediate segment 270 of the cam slot 216 causes the printing member 32 to pivot or rotate as the cam follower 218 moves upwardly or downwardly, and on the downward stroke this pivoting motion orients the printing elements in a downwardly-facing direction in preparation for printing. The shape of this segment is preferably elliptical, with the minor axis of the ellipse being parallel to the plane of the printing elements when the pivot block 176 is horizontal. The ellipse is defined by the following equation:

$$\frac{X^2}{E^2}+\frac{Y^2}{F^2}=1$$

where the values for E and F are determined by solving equations using the location of the cam follower 218 relative to the inner pivot axis of the printing member 32, and common points from the adjacent segments 268 and 272 of the cam slot 216.

The shape of the upper segment 272 is such that, in addition to causing the printing member to continue to pivot as the printing elements are brought into contact with the inking roll 112, the pivot axis of the printing member 32 is moved progressively toward and then away from the axis of the inking roll 112 in order to maintain uniform tangential contact between the inking roll and the printing elements. This shift in the pivot axis of the printing member 32 is made possible by the articulated mounting arrangement illustrated in FIG. 5, in which the pivot axis defined by the axes of the aligned holes 184 and 186 can shift relative to the fixed pivot axis defined by the holes 188. As in the case of the cam slot 105 of FIG. 7, the segment 272 of the cam slot 216 in FIG. 8 achieves the tangency function by causing the plane of the printing elements to shift gradually outward (i.e., closer to the axis of the inking roll 112) as the line of contact between the inking roll and the printing elements moves from the leading edge of the printing elements, and by causing the plane of the printing elements to shift gradually inward as the line of contact moves toward the trailing edge of the printing elements. However, since the inking roll 112 is already moving in a similar manner (although in the opposite direction) under the control of the cam 106, the segment 272 of the cam slot 216 is only required to move the printing member 32 in a complementary manner by the additional amount needed to maintain tangency between these two components. The profile of the segment 272 which is needed to accomplish this function is a complex shape which will depend upon the locations of the various pivot points in the printing apparatus 20 and the distances separating them. In general, however, each rotational angle of the cam 106 will define a corresponding position of the inking roll 112, and each such position of the inking roll 112 will require a specific position of the printing member cam follower 218 in order to maintain tangency. The profile of the cam slot segment 272 needed to establish these positions will be a function of the positions of the inking roll shaft 110, cam shaft 262, upper connecting link pivot 144, the two pivot axes of the printing member 32, and the lower connecting link pivot 156, at each point during the inking interval. A set of locations of the cam follower 218 defining a profile for the cam slot segment 272 can be calculated by the use of a conventional computer-aided design (CAD) software program, using the locations of the various pivot axes as input parameters. An example of such a program is the "ADAMS" mechanical systems simulation program that is available from Mechanical Dynamics, Inc. of Ann Arbor, Mich. Reference may also be had to commonly assigned U.S. Pat. No. 4,444,108, incorporated by reference herein, for a discussion of the mathematical principles involved in maintaining tangency between a rockably mounted inking roll and a planar printing element mounted for pivoting movement about an axis.

Figure 9:
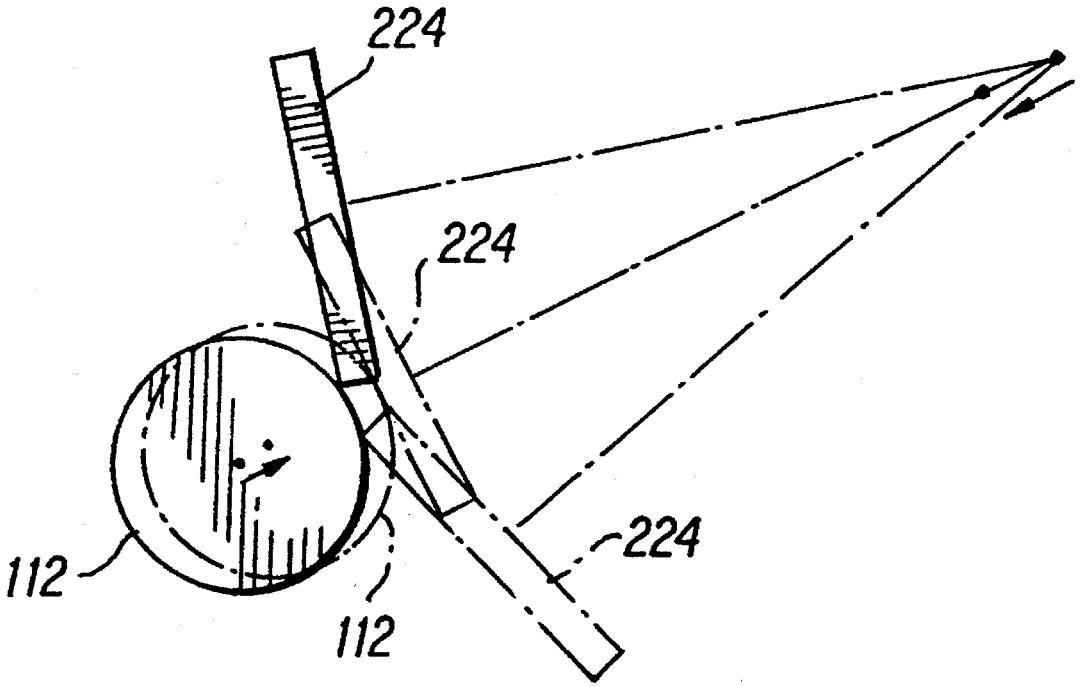
FIG. 9 is a schematic illustration of the manner in which tangency is maintained between the inking roll and printing elements in the printing apparatus in FIG. 2.

The motion of the inking roll 112 and printing elements 224 during the inking interval is shown schematically in FIG. 9. As illustrated, the inking roll 112 moves gradually toward and then away from the plane of the printing elements 224 under the control of the cam slot 105, as the inking roll mounting assembly 61 pivots about the shaft 70. At the same time, the printing elements 224 move gradually toward and away from the inking roll 112 under the control of the fixed cam slot 216, as the printing member pivot axis defined by the holes 184 and 186 in FIG. 5 shifts relative to the fixed axis defined by the hole 188. In this way, the two cam surfaces operate in a complementary manner to maintain tangency between the inking roll 112 and printing elements 224. The two cam surfaces also cooperate to move the inking roll 112 and printing elements 224 rapidly toward each other so that they make contact abruptly at the beginning of the inking interval, and to separate them in a similar manner at the end of the inking interval. This results from the fact that the rise and fall portions of the two cam profiles extend beyond the contact interval between the inking roll and printing elements, and the cam profiles can be made steeper at either end of this interval, if desired, in order to enhance this function. By thus initiating and withdrawing contact between the inking roll and printing elements quickly, rather than gradually, the problem of ink accumulating on the leading and trailing edges of the printing elements 224 is avoided.

Figure 10A:
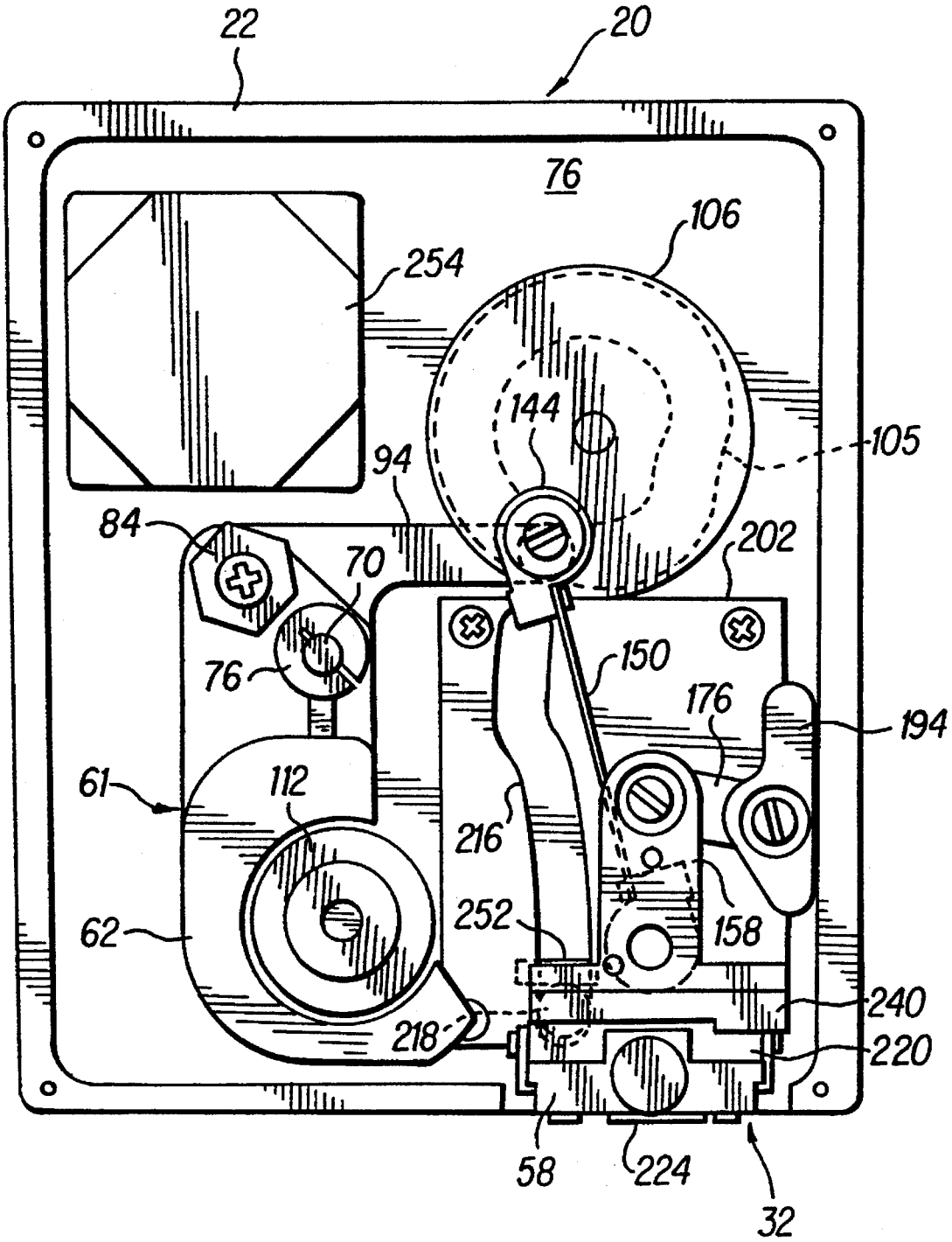
FIGS. 10A–10G are sequential views of the printing apparatus of FIG. 2, illustrating a complete cycle of operation.
Figure 10B:
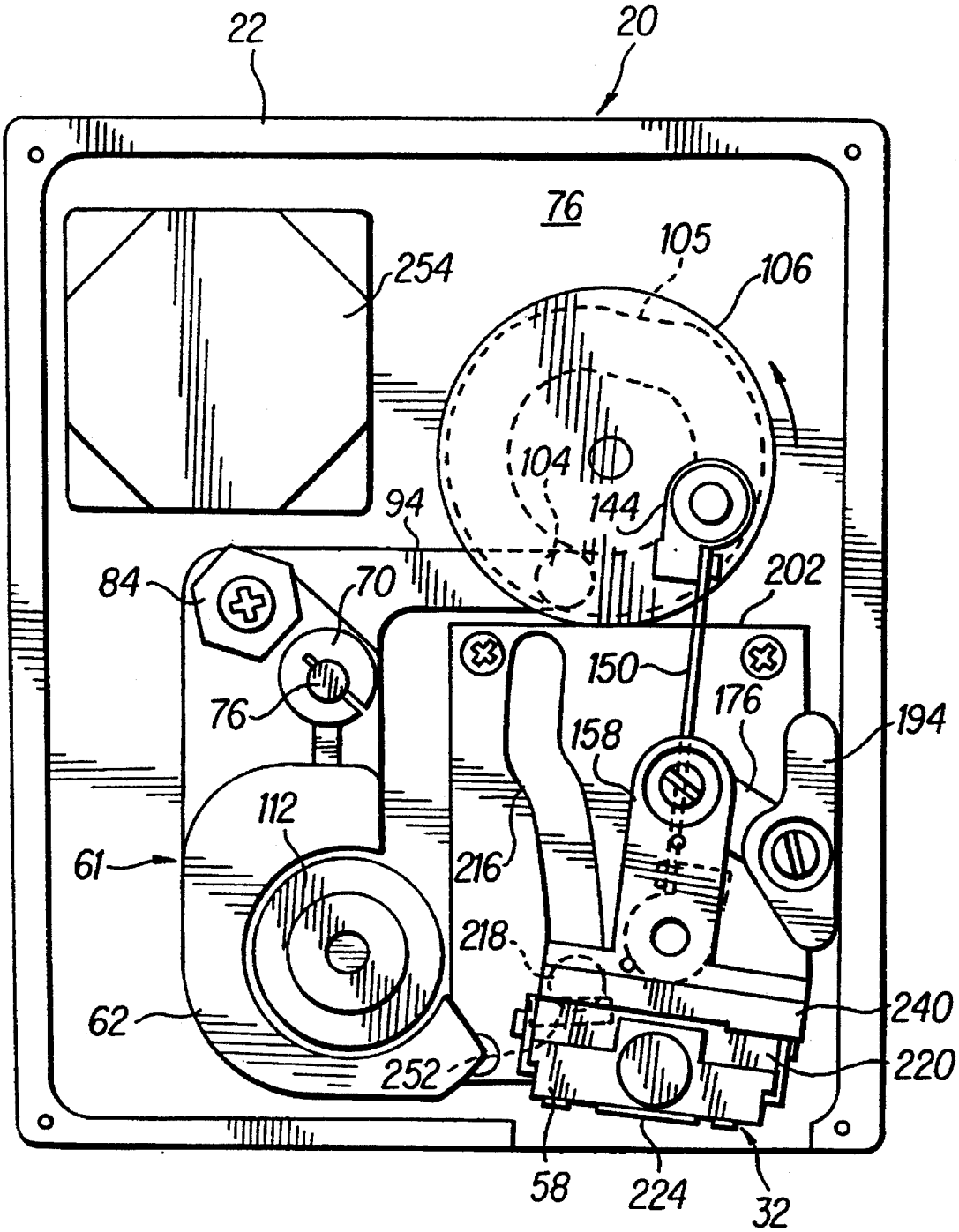
Figure 10C:
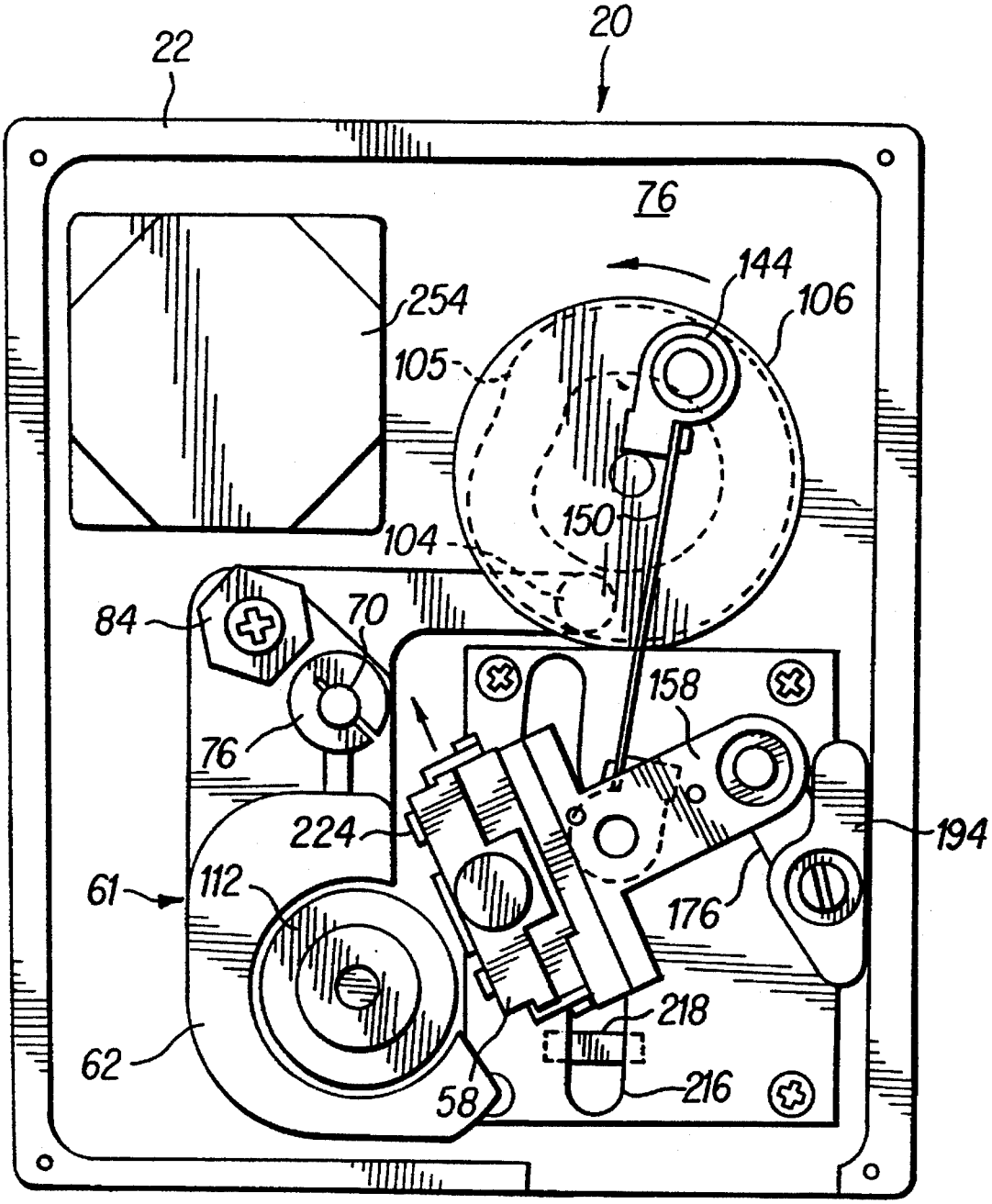
Figure 10D:
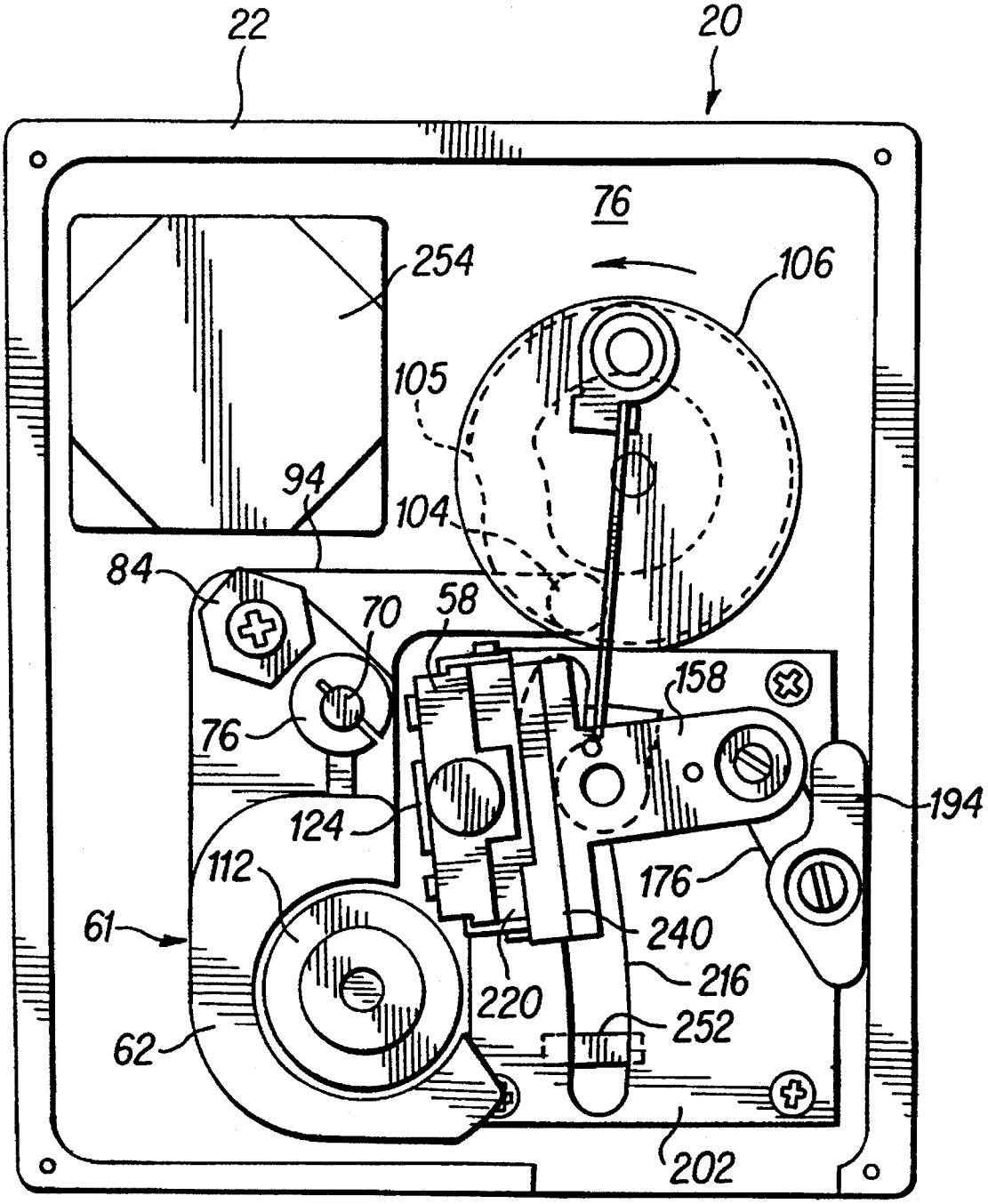
Figure 10E:
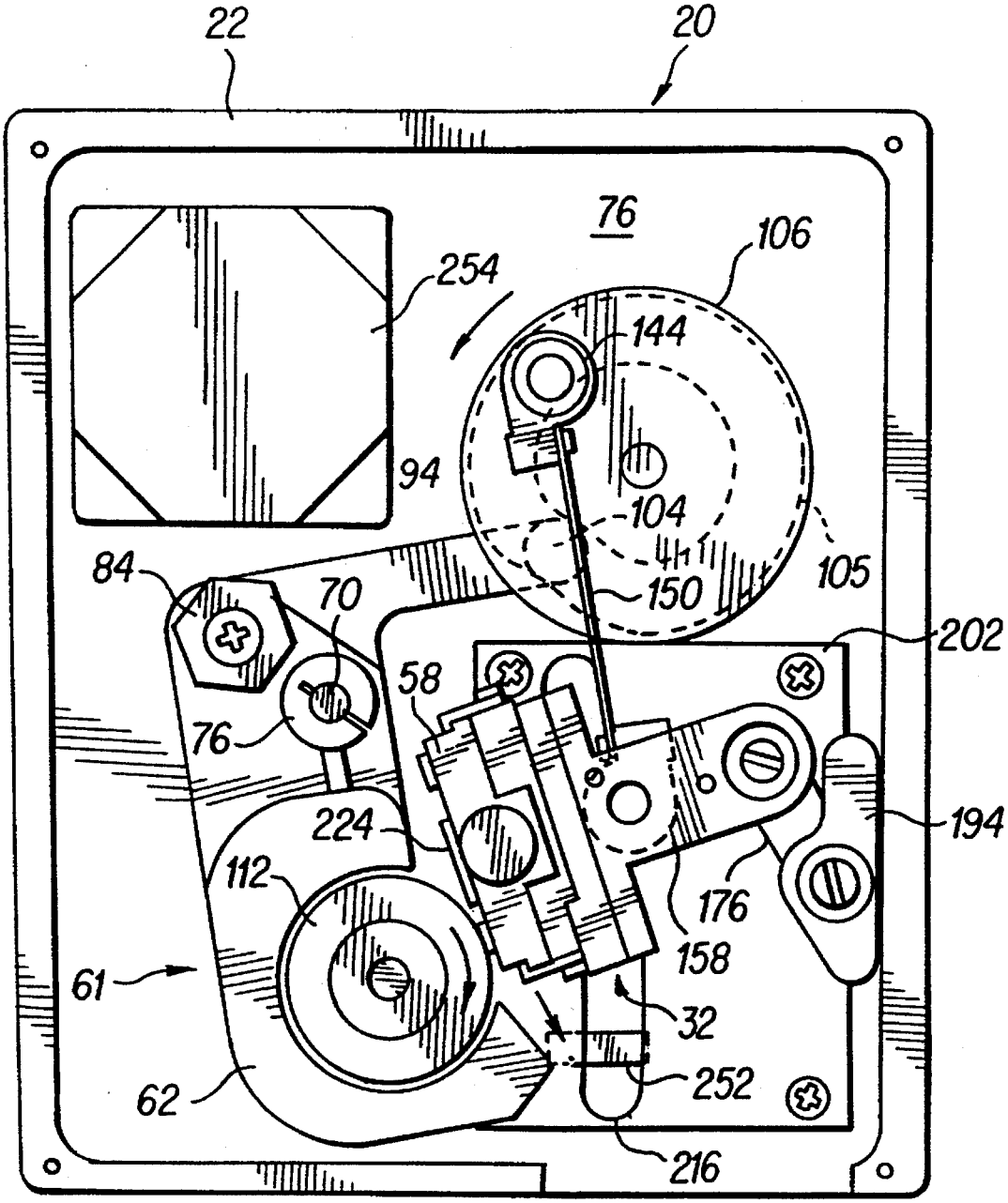
Figure 10F:
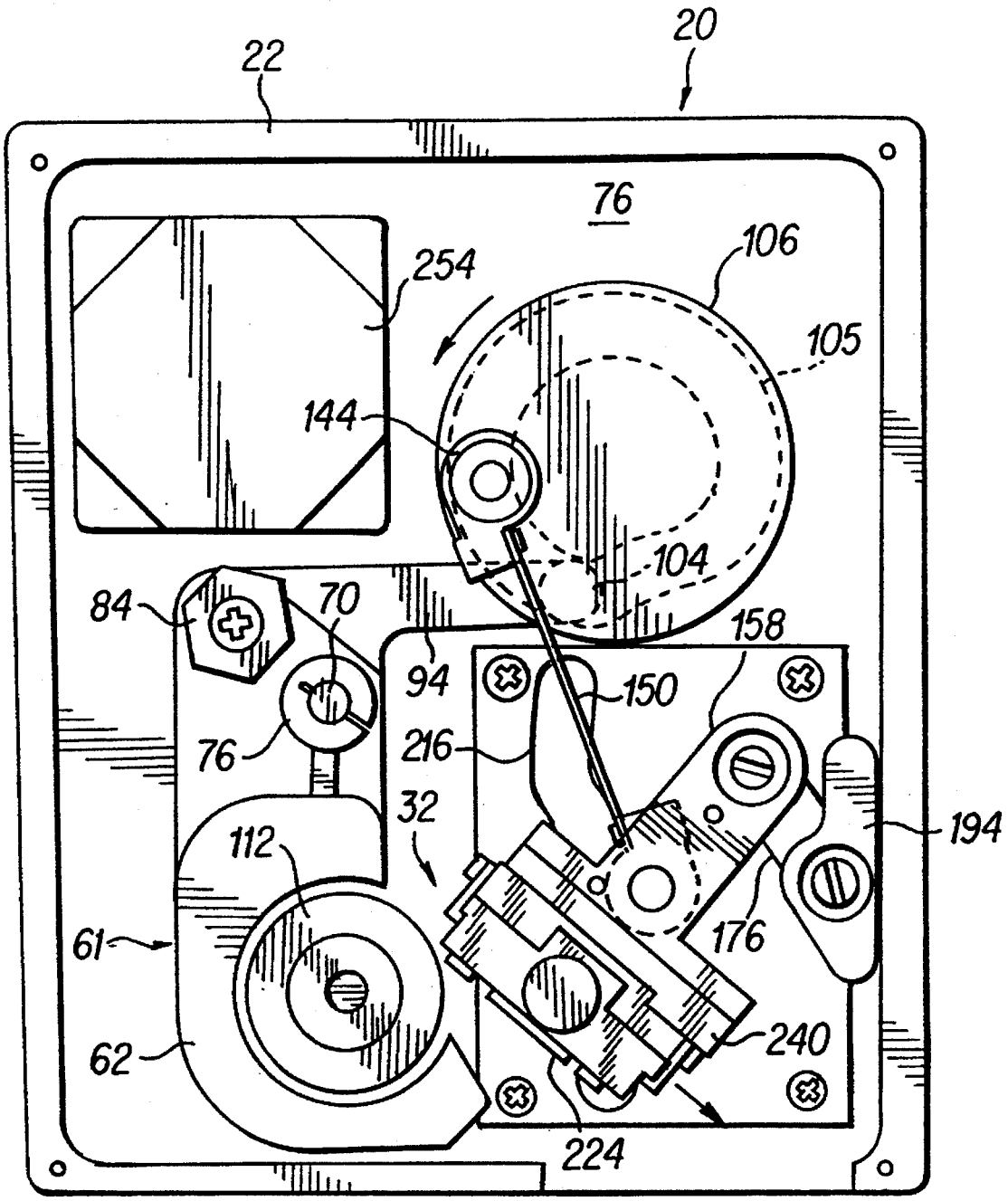
Figure 10G:
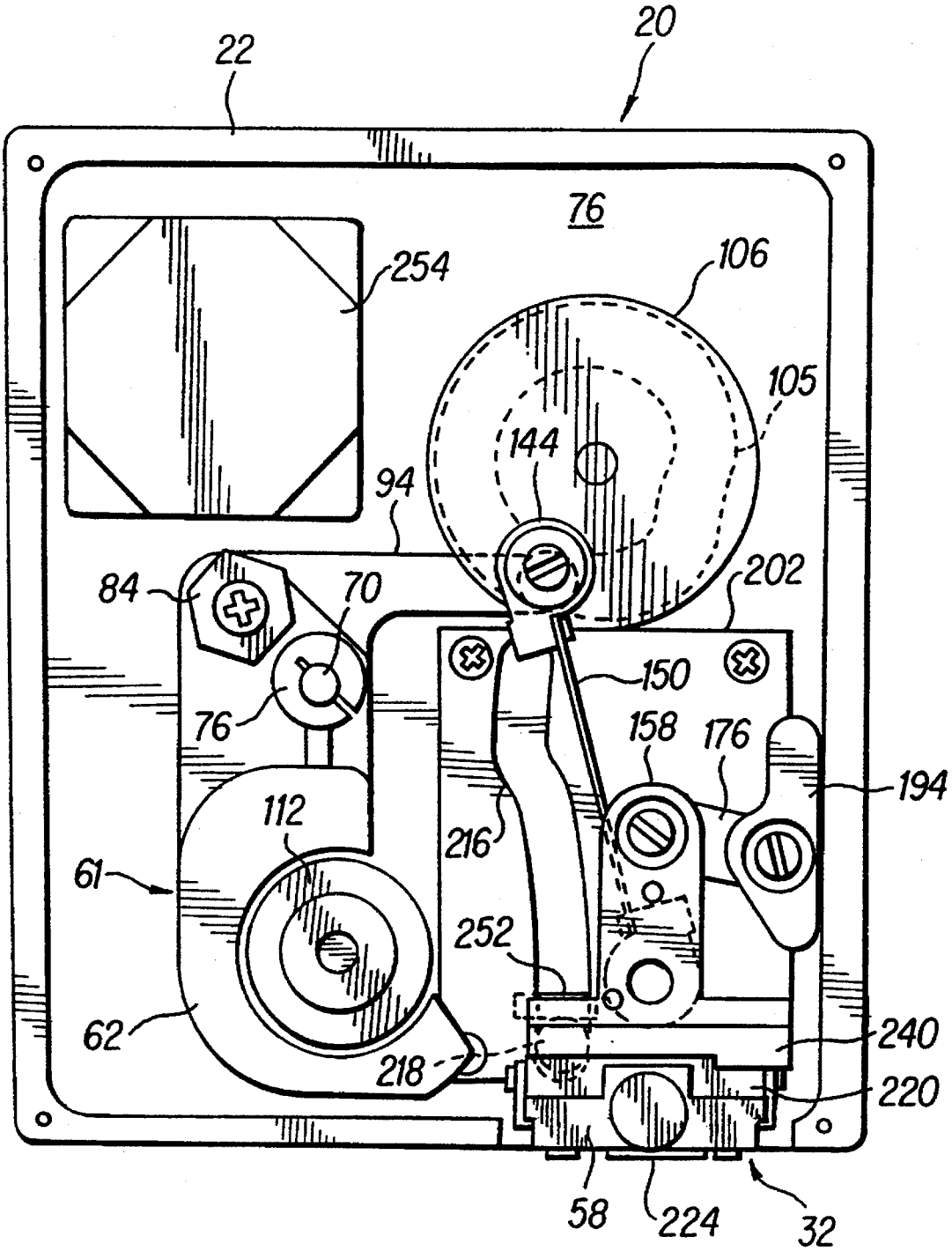

FIGS. 10A–10G are sequence views illustrating a complete cycle of operation of the printing apparatus 20. In FIG. 10A, the printing member 32 is shown in the home or rest position prior to the start of a printing cycle. The ink roll mounting assembly 61 is in the retracted position, and the cam follower 218 is at a position somewhat above the bottom of the fixed cam slot 216 and within the sensing range of the sensor 252. When a printing cycle is initiated, the cam 106 begins to turn in a counter-clockwise direction, causing the connecting link 150 to move downwardly. This causes a corresponding downward translational motion of the printing member 32 in order to bring the printing elements into contact with the surface to be printed. As the cam 106 continues to turn, the connecting link pivot 144 leaves the bottom center position, causing the connecting link 150 to move upwardly and the printing elements 224 to separate from the printed surface. After further rotation of the cam 106, the cam follower 218 enters the intermediate segment 270 of the cam slot 216, and this causes the printing member 32 to begin to pivot or rotate to the left as shown in FIG. 10B. Further rotation of the cam 106 causes the connecting link pivot 144 to approach the top center position, at which point the follower 218 has entered the top segment 272 of the cam slot 216 and printing member 32 is near the top of its stroke as illustrated in FIG. 10C. Throughout this interval, the inking roll mounting assembly 61 has remained in the retracted position because the cam follower 104 is in the dwell portion of the enclosed cam slot 105. When the printing member 32 reaches the top of its stroke, as illustrated in FIG. 10D, the follower 104 leaves the dwell portion of the cam slot 105 and begins to rock the inking roll mounting assembly 62 in the right-hand direction toward the printing member 32. In FIG. 10E, the printing member 32 has begun to move downwardly and, with the ink roll mounting assembly 61 having been rocked in the right-hand direction by the cam follower 104, the inking roll 112 is brought into contact with the leading edge of the printing elements 224. The cam follower 104 has now moved into the harmonic rise portion of the cam slot 105, and the cam follower 218 is still in the top segment 272 of the fixed cam slot 216. Accordingly, as the cam 106 continues to turn, the cam slots 105 and 216 progressively shift the positions of the inking roll mounting assembly 61 and printing member 32 in a complementary manner in order to maintain uniform tangential contact between the inking roll 112 and the planar surface of the printing elements 224, as described previously. Following the inking interval, the cam slots 105 and 216 cause the inking roll 112 and printing elements 224 to separate, with the inking roll mounting assembly 61 being restored to its rest or retracted position as illustrated in FIG. 10F. The cam follower 218 has now entered the intermediate segment 270 of the slot 216, which rotates the printing member 32 so that the printing elements 224 face downward. With further rotation of the cam 106, the printing member 32 is restored to the home or rest position as shown in FIG. 10G. At this point, the presence of the cam follower 218 has been detected by the sensor 252, and this causes the control system to halt the operation of the stepping motor 254. This brings the cam 106 to a stop and terminates the printing cycle.

Figure 11:
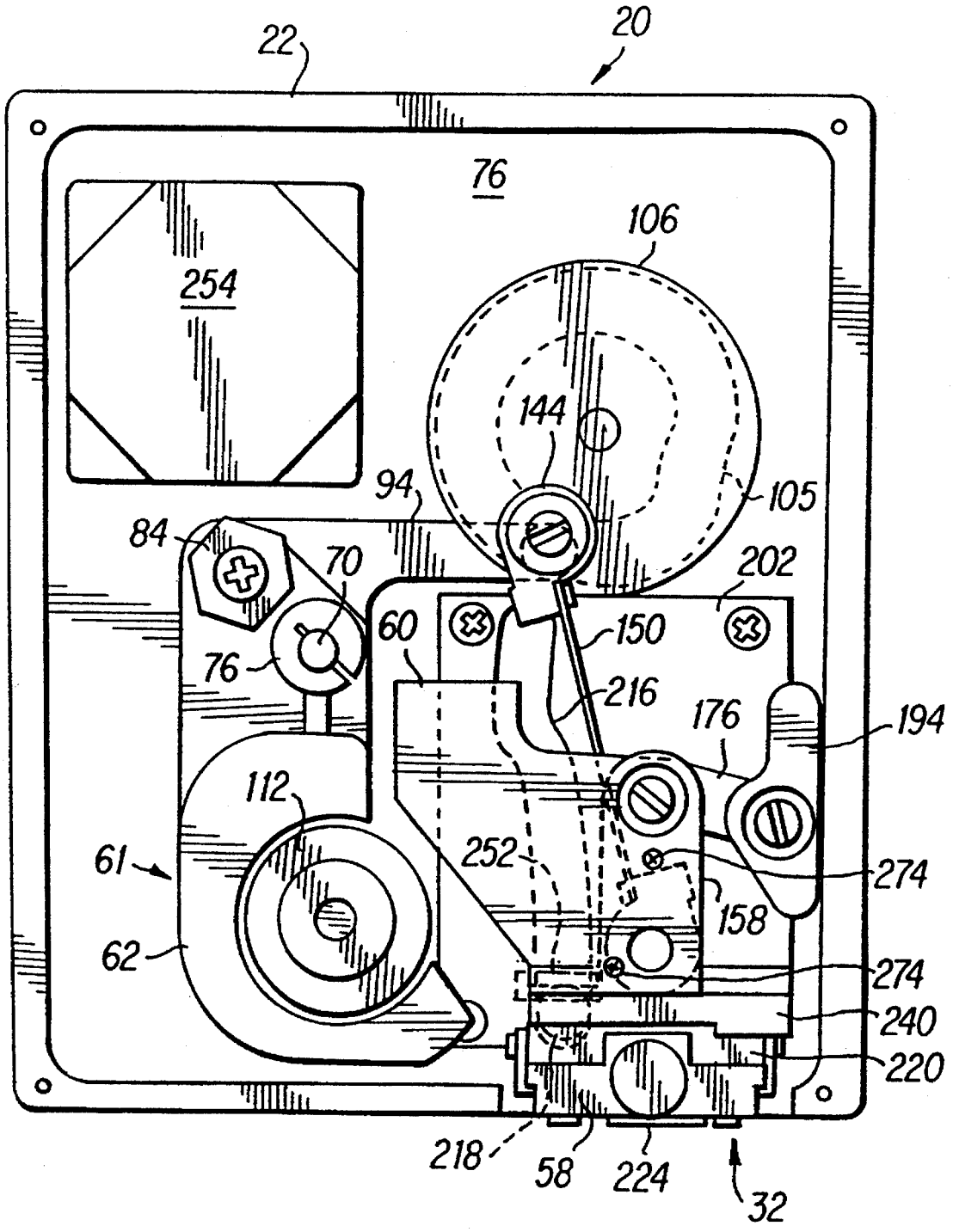
FIGS. 11 and 12 illustrate the manner in which the filler plate operates as a safety feature in the printing apparatus of FIG. 2.
Figure 12:
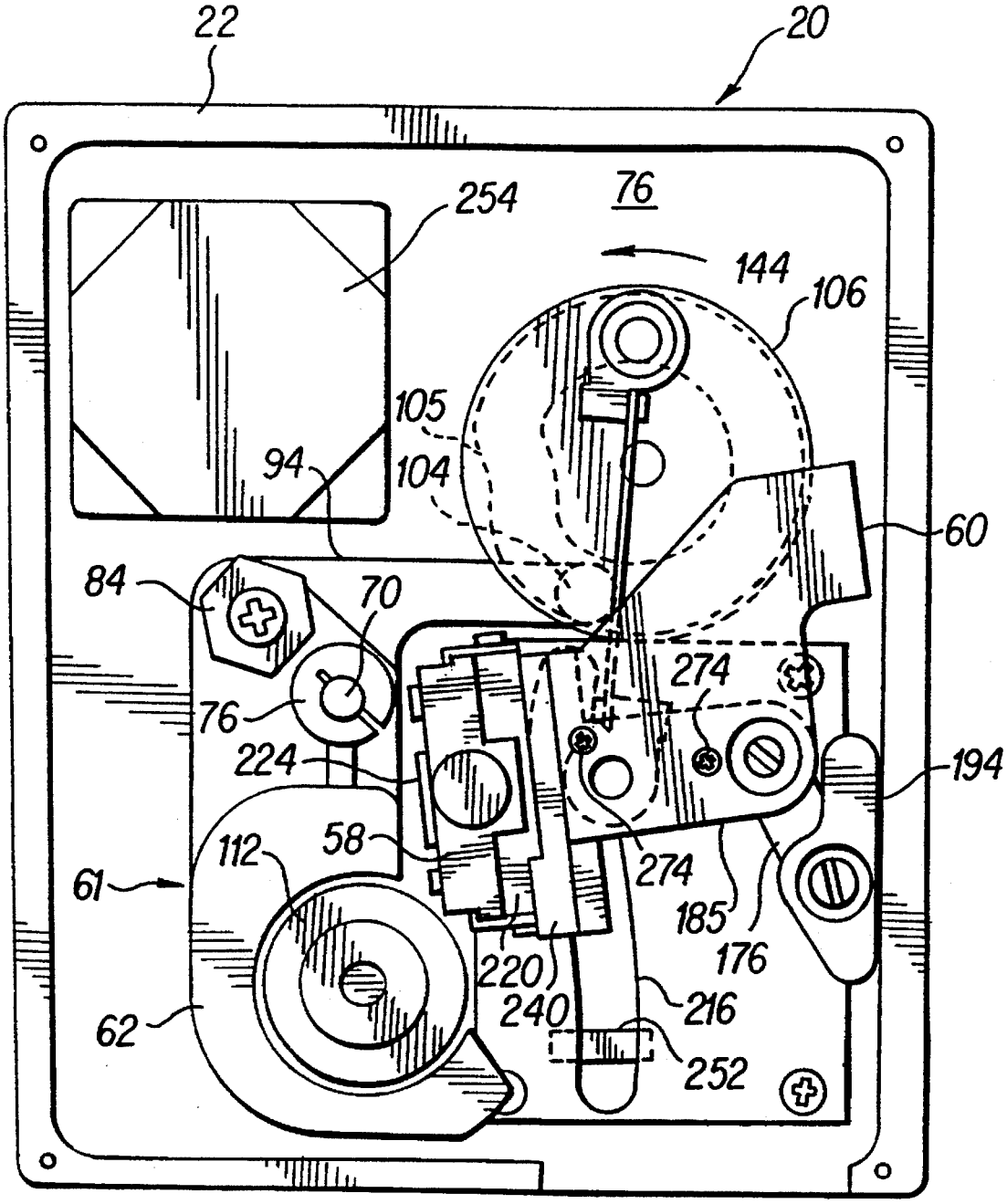

FIGS. 11 and 12 illustrate the manner in which the filler plate 60 (which was deleted from some of the previous views) is caused to move along with the printing member 32 during a printing cycle. The filler plate 60 is attached by means of a pair of screws 274 to the heater block holder 158, which is provided with threaded holes 276 (visible in FIG. 3) for engaging the screws 274. Thus, the filler plate 60 is carried by the printing member 32 and moves upwardly and downwardly along with the printing member during each printing cycle. In FIG. 11, the printing member 32 is shown in the home or rest position, and in this position it will be observed that the filler plate 60 will close off the area of the slot 56 (FIG. 1) above the handle 59 of the type holder 58. When the printing member reaches the top of its stroke, as illustrated in FIG. 12, the handle 59 is near the top of the slot 56 is FIG. 1 and the filler plate has been pivoted to a non-blocking position. It will be observed that the filler plate is shaped in such a manner as to cover the portion of the slot above the type holder handle 59 at the home or rest position the printing member 32, thereby preventing the insertion of a finger or other object into the slot, and to avoid interference with the inking roll mounting assembly 61 and other internal parts of the printing apparatus 20 during its movement.

Figure 13:
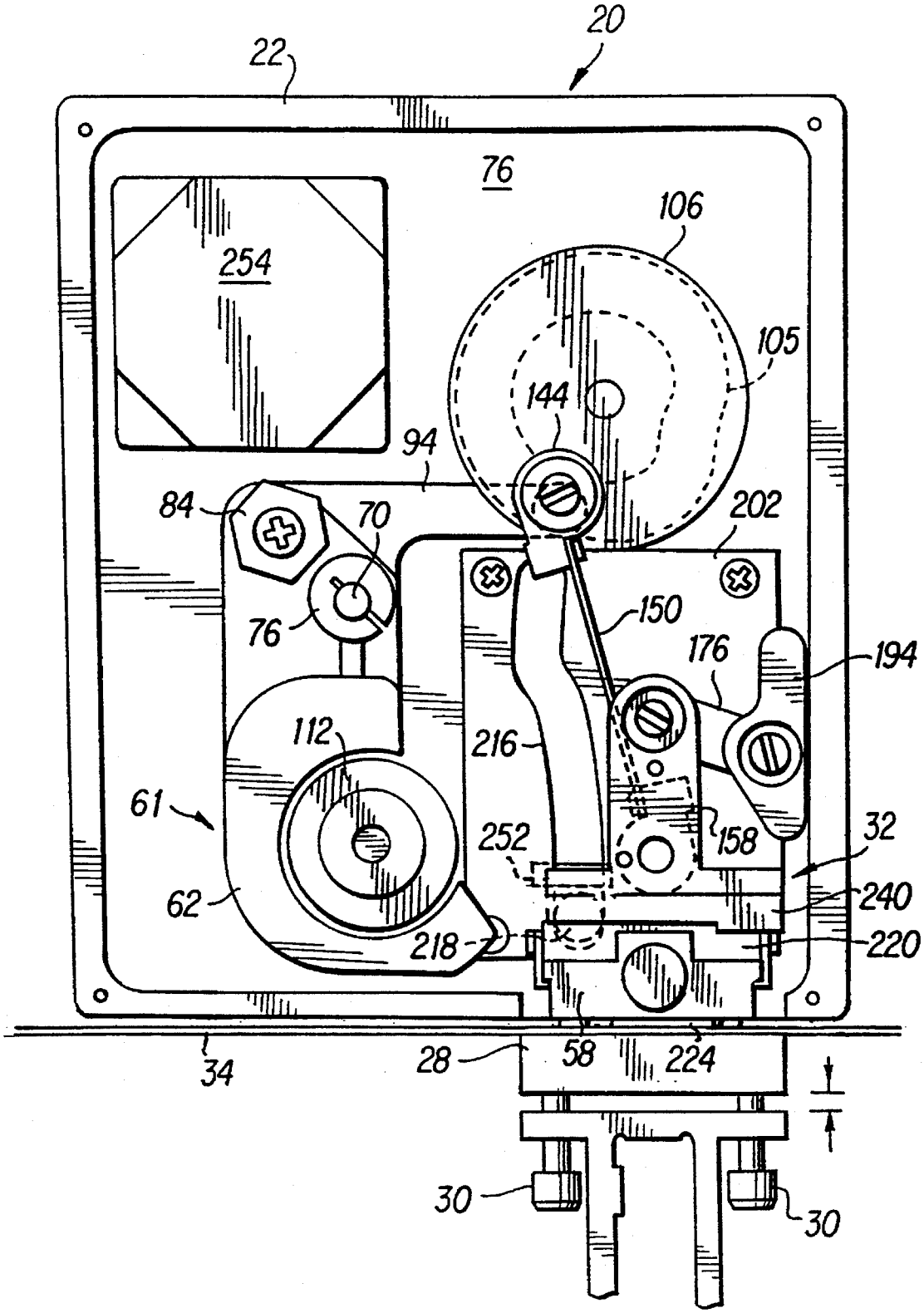
FIGS. 13 and 14 illustrate the manner in which the printing apparatus of FIG. 2 responds to normal and excessive printing pressures, respectively.
Figure 14:
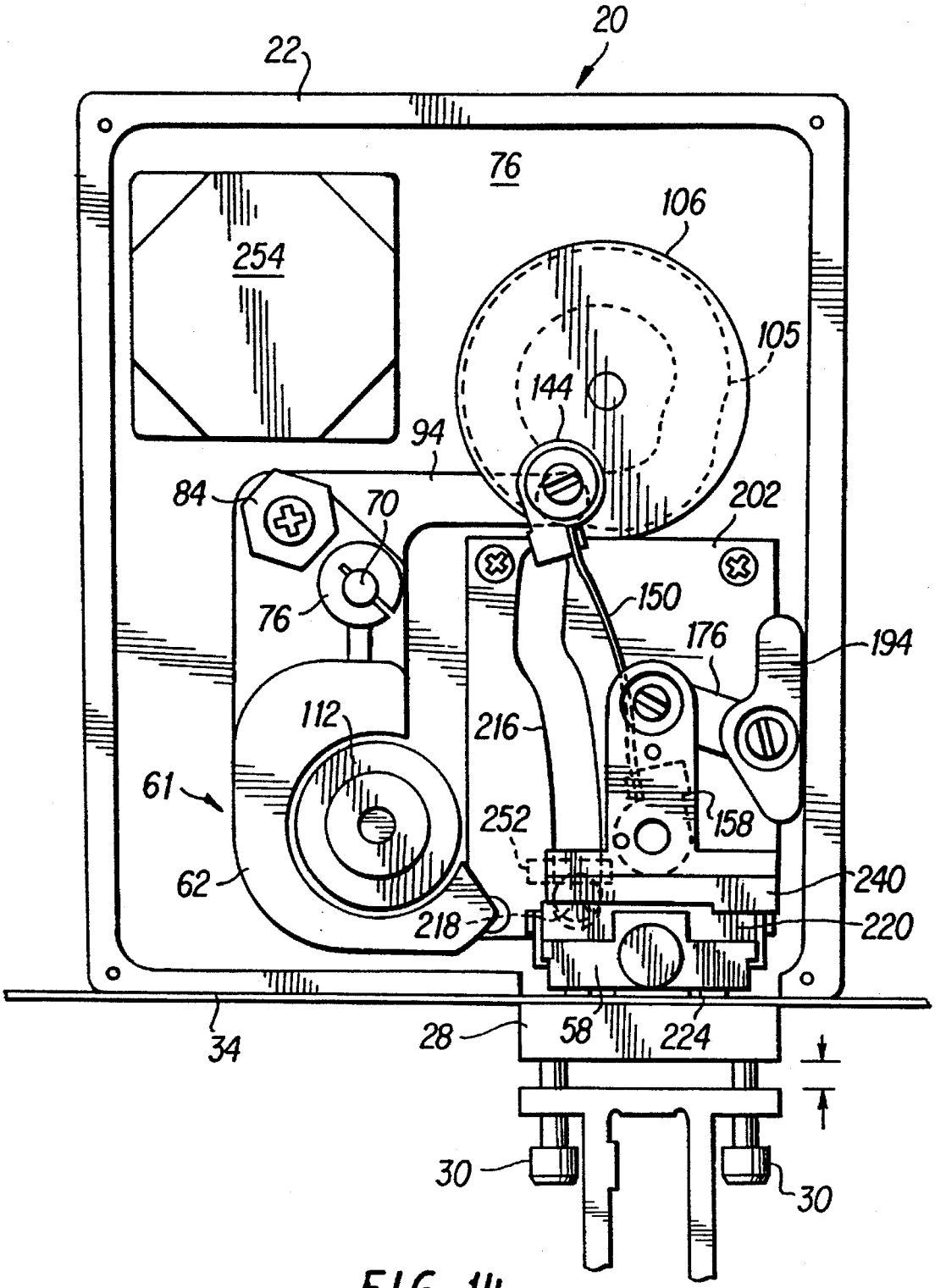

FIGS. 13 and 14 illustrate the manner in which the yieldable connecting link 150 prevents an excessive printing pressure from being applied to the work table 28 by the printing member 32. In FIG. 13, the printing apparatus 20 is shown during a normal printing cycle in which the height of the work table 28 is properly adjusted. The printing member 32 is at or near the bottom of its stroke, with the printing elements 224 in contact with the web 34 and work table 28.

Although a compression force is being applied to the connecting link 150, the printing pressure is within the normal range and is not sufficient to cause the link 150 to flex or deform to any appreciable degree. In addition, it will be observed that the cam follower 218 is at a position in the cam slot 216 which is below the sensing range of the sensor 252, indicating to the control system that the printing member has been allowed to reach the bottom of its travel and that the connecting link 150 has not been caused to flex or deform. In FIG. 14, the work table 28 has been adjusted to an abnormally high position, as might occur due to improper set-up. In this case, as the printing member 32 attempts to move downwardly under the control of the cam 106 and connecting link 150, it encounters the web 34 and work table 28 at a slightly earlier point during the print cycle. As the cam 106 continues to turn, the excessive printing pressure caused by the improper height adjustment of the work table 28 causes the yieldable connecting link 150 to flex or yield, as shown. This attenuates the impact of the printing member 32 against the work table 28, and prevents excessive mechanical forces from being transmitted throughout the printing apparatus 20. In addition, since the reduced vertical travel of the printing member 32 has not allowed the cam follower 218 to move out of the sensing range of the sensor 252, the sensor continues to detect the cam follower 218 and the control system interprets this as an indication that an excessive printing pressure has occurred. If this condition persists through a number of successive printing cycles, the operation of the printing apparatus will stop and an error indication will be displayed by the control unit 36. The control unit 36 will not permit the printing apparatus 20 to respond to subsequent start signals until the error condition has been cleared.

Figure 15:
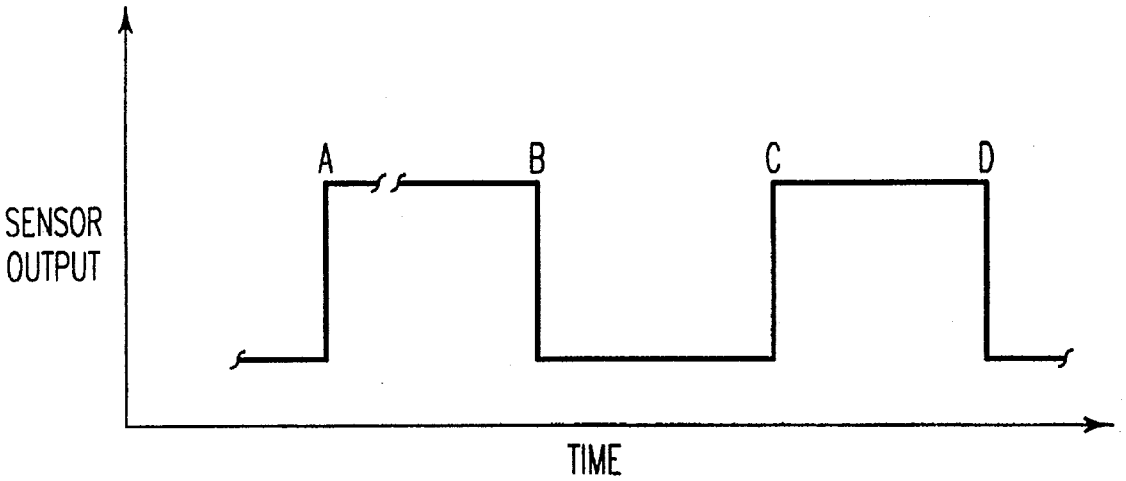
FIGS. 15 and 16 are timing diagrams illustrating the output signal of the home position sensor used in the printing apparatus of FIG. 2, under conditions of normal and excessive printing pressure, respectively.
Figure 16:
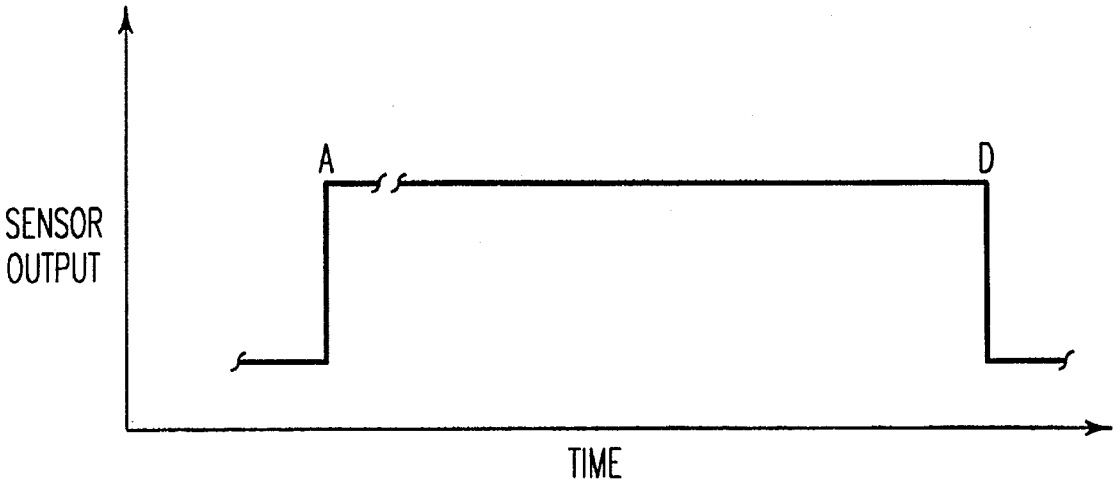

FIGS. 15 and 16 are timing diagrams which illustrate the output signal of the sensor 252 under conditions of normal and excessive printing pressure, respectively. Referring first to FIG. 15, let it be assumed that the printing member 32 is already in motion from a previous printing cycle and is approaching the home position as shown in FIG. 10G. As the home position is approached, the cam follower 218 is detected by the sensor 252, and the stepping motor 254 continues to run for a predetermined number of steps until the home position is reached. The point A in FIG. 15 represents the positive transition of the sensor output that occurs when the cam follower 218 is first detected. After a new print cycle is initiated, the stepping motor 254 begins to operate once again, causing the printing member to execute a downward motion into contact with the surface to be printed followed by an upward motion away from the surface. The point B in FIG. 15 represents the moment during the initial downward motion of the printing member 32 when the cam follower 218 moves out of the sensing range of the sensor 252, and the point C represents the moment at which the cam follower again enters the sensing range of the sensor 252 during the upward stroke of the printing member 32. As the printing member 32 continues its upward stroke in the direction of the ink roll mounting assembly 61 (FIG. 10B), the cam follower 218 again moves out of the sensing range of the sensor 252. This is represented by the point D in FIG. 15. The sensor 252 then does not detect the cam follower 218 until the printing member 32 once again approaches the home position at point A. Thus, during a normal printing cycle, the output signal from the sensor 252 is characterized by two rising edges, represented by the points A and C in FIG. 15.

FIG. 16 illustrates the sensor output that will occur in a situation where the printing pressure is excessive due to a misadjustment of the height of the work table 28. If the work table 28 is set too high by the operator, the printing member 32 is not able to reach the downward limit of its normal travel and hence the cam follower 218 never moves out of the sensing range of the sensor 252 during the interval when the printing member is brought into contact with the surface to be printed. Thus, the sensor output maintains a high level between the points A and D as shown in FIG. 16. As will be discussed in more detail hereinafter, the control system is programmed to detect the fact that only one rising edge of the sensor output has occurred (i.e., at point A), and this is taken as an indication that the printing pressure is excessive. Under these conditions, power is removed from the stepping motor 254 after a predetermined interval to stop the motion of the printing member 32, and an error message is displayed to the operator using the LCD array 42 of the control unit 36 in FIG. 1. The reduced travel of the printing member 32 is permitted by the flexure of the connecting link 150. Thus it will be appreciated that, in addition to absorbing mechanical forces that would otherwise be transmitted to the printing apparatus 20 as a result of the excessive printing pressure, the link 150 performs the additional function of allowing the sensor 252 to operate.

Figure 17:
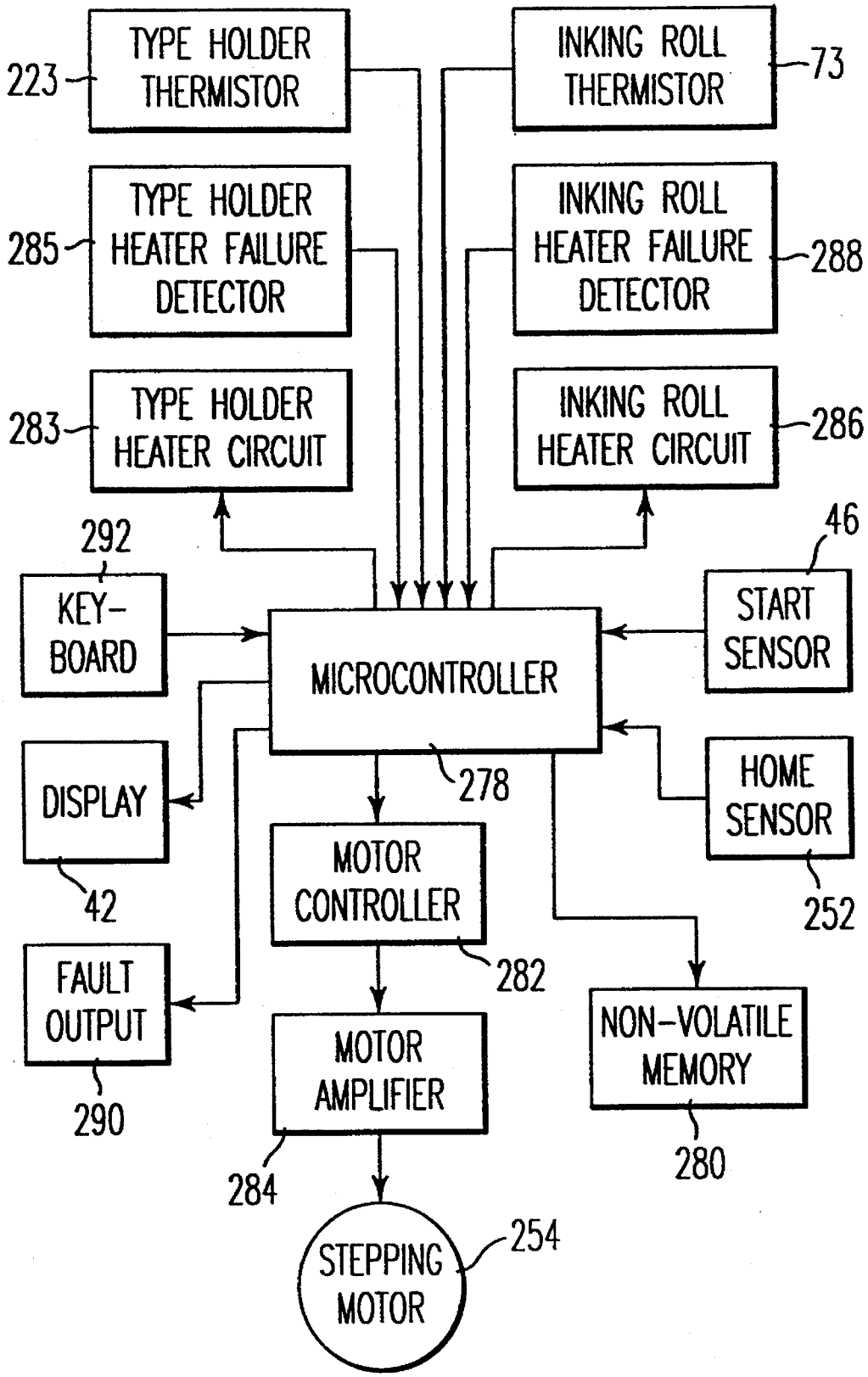
FIG. 17 is a block diagram illustrating the electrical components of the printing apparatus of FIG. 2 and the manner in which they are interconnected.

FIG. 17 is a block diagram of the electrical components of the printing apparatus 20. Some of these components are contained in the control unit 36 of FIG. 1, and others are contained in the printing apparatus 20. The printing apparatus 20 is controlled by means of a microprocessor-based controller 278, which is connected to a non-volatile memory 280 for storing set-up information, fault history data, and the like. The microcontroller 278 receives inputs from the start sensor 46 of FIG. 1, and from the home position sensor 252 of FIG. 5. In response to these inputs, the microcontroller applies stepping pulses to the stepping motor 254 by means of a motor controller circuit 282 and an amplifier circuit 284. Preferably, the motor control circuit 282 includes a circuit which reduces the current applied to the stepping motor 254 to a holding value when the printing member 32 is not required to move. The microcontroller 278 contains a look-up table that provides the delay time between each successive stepping movement of the stepping motor 254, so that the printing member 32 can be made to move at different speeds during different segments of the printing cycle. Generally, slower speeds are used during the inking and printing intervals, and also during intervals when the profiles of the cam slots 105 and 216 are steeply ascending or descending. The microcontroller 278 includes suitable random access memory (RAM) and erasable programmable read-only memory (EPROM) for storing the necessary program instructions and the look-up table referred to previously.

The microcontroller also controls a type holder heater circuit 283 which applies current to the type holder heating elements 222 of FIG. 5. A type holder heater failure detector 285 monitors the current to the heating elements 222 and provides a signal to the microcontroller 278 when the current is too low, indicating that one of the parallel-connected heating elements has become open-circuited. This will cause a fault indication to be displayed by the control unit 36 of FIG. 1. The type holder thermistor 223 provides a temperature input to the microcontroller 278, allowing the microcontroller 278 to control the type holder heater circuit 283 in such a manner as to maintain a uniform temperature in the type holder heater block 220 of FIG. 5. A similar heater circuit 286, heat failure detector 288, and thermistor 73 are provided for the inking roll heater block 64 shown in FIG. 4.

The microcontroller 278 provides outputs to the display 42 of FIG. 1 in order to alert the operator to various machine conditions. Under normal circumstances, the output 42 provides a continuous read-out of the inking roll and type holder heater block temperatures. In the event of a fault condition, however, an appropriate error message may be displayed to the operator by means of the display 42 and light-emitting diode (LED) indicators (not shown) may also be illuminated. The microcontroller 278 is also connected to a fault output circuit 290 which may comprise a relay driver that is energized when a fault condition is detected. The circuit 290 can be used to close a relay in order to sound an alarm, stop the motion of the conveyor system, or take such other action as may be determined in advance. The membrane keypad switches 40 are connected to the microcontroller 278 to allow various machine set-up conditions to be entered, such as the desired temperatures of the inking roll and type holder heater blocks.

Figure 18A:
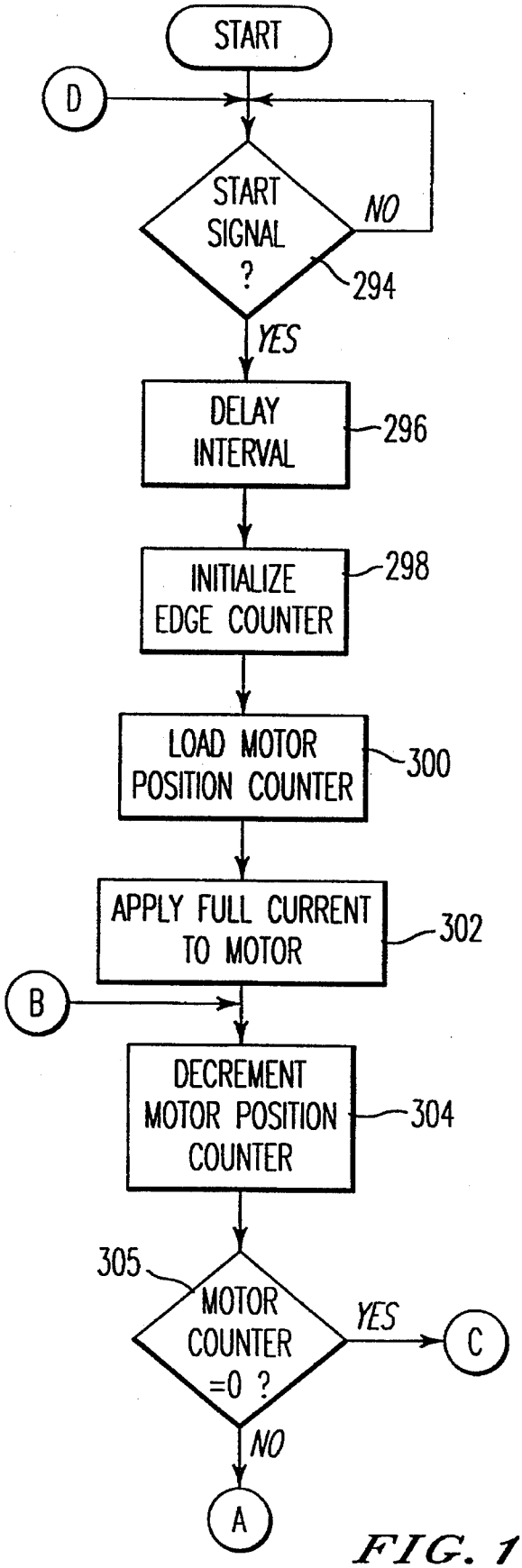
FIGS. 18A–18C comprise a flow chart illustrating the sequence of operations carried by the control system of the printing apparatus of FIG. 2 during a printing cycle.
Figure 18B:
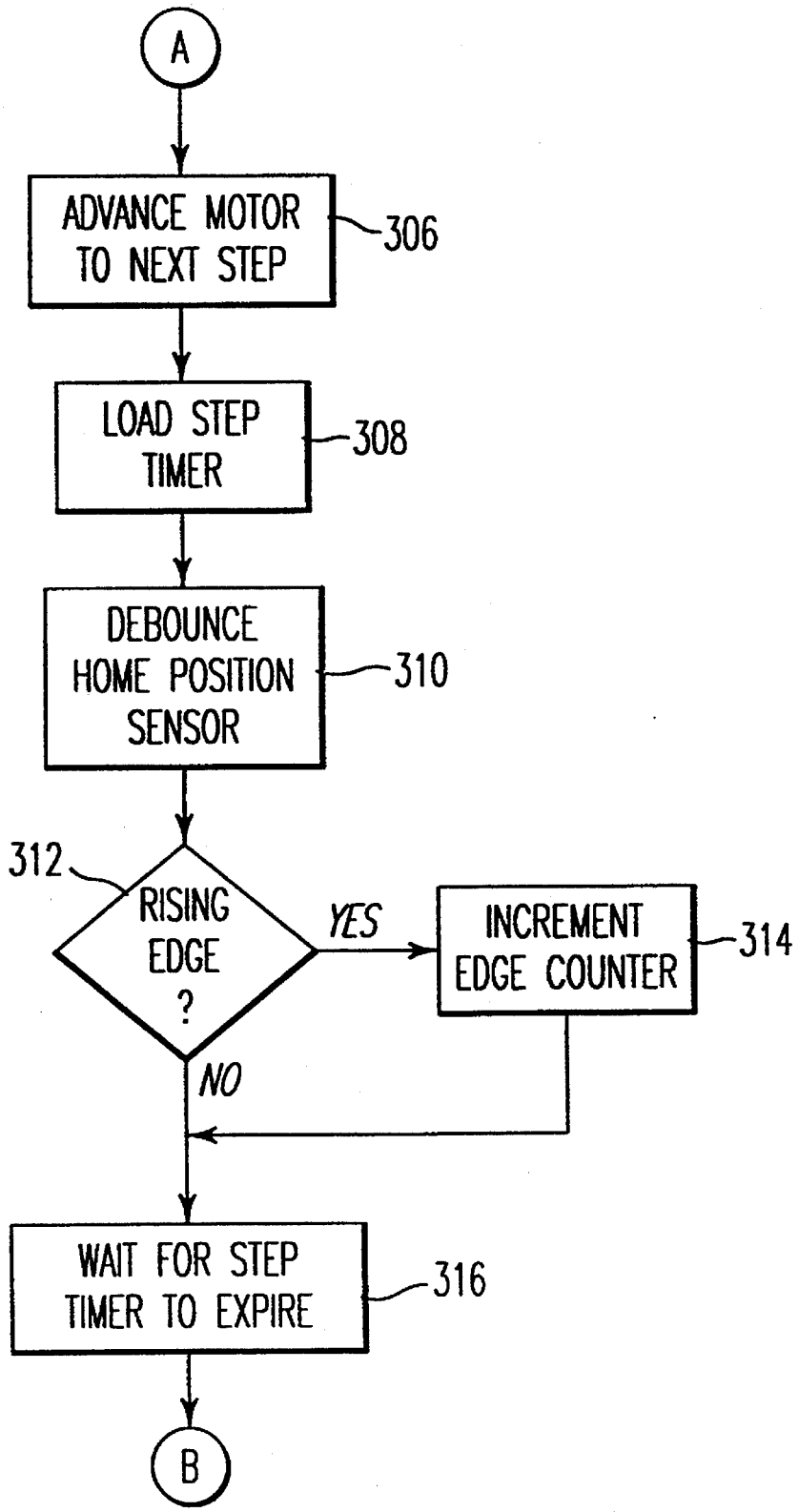
Figure 18C:
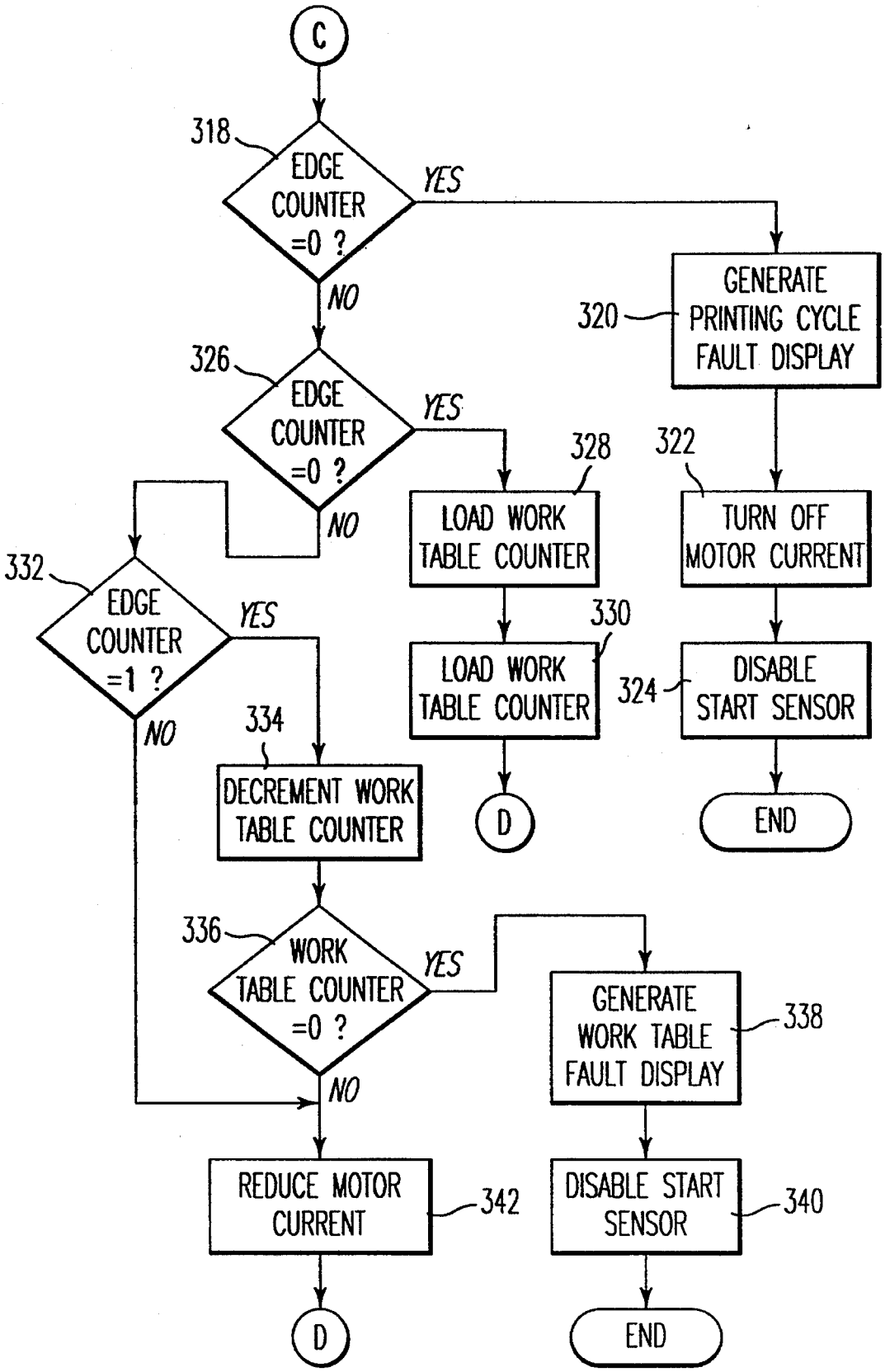

FIGS. 18A–18C comprise a flow chart indicating the series of operations carried out by the microcontroller 278 of FIG. 17 during a printing cycle. In decision block 294, the microcontroller repeatedly checks to determine whether a start signal has been received from the start sensor 46 of FIG. 1, and when this occurs, a programmable delay interval is commenced as indicated in block 296. The delay interval insures that the web 34 has completely stopped moving before a printing cycle is initiated, and is preferably adjustable to a value between 0 and 250 milliseconds. After the delay interval expires, the microcontroller 278 proceeds to block 298 and initializes an edge counter to a zero value. The edge counter is used to check for two rising edges from the output of the home position sensor 252 as illustrated in FIG. 15. When this step has been completed, the microcontroller proceeds to block 300 and loads a motor position counter with a value corresponding to the total number of motor steps required to move the printing member 32 through a complete printing cycle. In an exemplary embodiment, the motor position counter is loaded with an initial value of 400. In block 302, the microcontroller removes the holding current from the stepping motor 254 and applies full current in preparation for the printing cycle. The microcontroller then proceeds to block 304, where the motor position counter is decremented by one. In decision block 305, a determination is made of whether the motor position counter has been decremented to a zero value. If this has not occurred, the microcontroller proceeds to block 306, where the stepping motor 254 is advanced to the next step by applying an appropriate input to the motor controller 282 of FIG. 17. In block 308, the microcontroller checks the stored look-up table to determine the programmed delay time before the next motor step, and loads this value into a step timer. In block 310, the microcontroller 278 "debounces" the output signal from the home position sensor 252 by checking several times for a rising edge. This reduces the possibility that a rising edge will be detected in error as a result of electrical noise signals from other parts of the printing apparatus. In decision block 312, the microcontroller 278 determines from the debouncing procedure whether a rising edge has in fact been detected at the output of the home position sensor 252. If so, the cam follower 218 has been detected and the microcontroller proceeds to block 314 and increments the edge counter by one. After incrementing the edge counter, or in the event that a rising edge has not been detected, the microcontroller proceeds to block 316 and waits for the step timer to expire. When this occurs, the microcontroller loops back to block 304 and again decrements the motor position counter.

The sequence of steps described above will continue until the motor position counter has been decremented to a zero value. When this condition is detected in decision block 305, the microcontroller 278 proceeds to decision block 318 and determines whether the edge counter still contains a zero value. If it does, indicating that the printing member has not moved from the home or rest position due to an obstruction or system failure, the microcontroller proceeds to block 320 and generates a display to indicate to the operator that a printing cycle fault has occurred. This may consist, for example, of a display reading "PRINTING CYCLE NOT COMPLETED" on the LCD array 42 of FIG. 1. The microcontroller then proceeds to block 322, where the current to the stepping motor 254 is turned off, and then to block 324, where the start sensor is disabled to prevent any further printing cycles from being initiated until the fault condition is cleared.

If the edge counter is not found to have a zero value in decision block 318, the microcontroller proceeds to a further decision block 326 and checks to determine whether the edge counter value is equal to 2, indicating that the work table height has been properly adjusted. If so, the microcontroller proceeds to block 328 and loads a work table counter with a predetermined value, typically 5. The work table counter allows an excessive printing pressure to be detected several times in succession without causing a fault condition, which facilitates initial set-up of the printing apparatus and also provides some degree of tolerance for periodic variations in web thickness or product height. In block 330, the stepping motor current is reduced to the holding value. The microcontroller then returns to decision block 294 to await a further start signal.

If the edge counter value is found not to be equal to 2 in decision block 326, the microcontroller proceeds to a further decision block 332 and determines whether the edge counter value is equal to 1, indicating that the work table has been adjusted too high. If so, the microcontroller proceeds to block 334 and decrements the work table counter by one. In decision block 336, a determination is made of whether the work table counter has been decremented to a zero value. If so, the fault condition has persisted through five successive printing cycles and the microcontroller generates a work table fault display as indicated in block 338. This may consist, for example, of a display which reads "WORK TABLE TOO HIGH" on the LCD array 42 of FIG. 1. In block 340, the microcontroller disables the start sensor 46 to ensure that no further printing cycles are initiated until the fault condition is cleared. If the work table counter is found not to contain a zero value in decision block 336, or if the value of the edge counter is found not to equal 1 in decision block 332, the microcontroller proceeds to block 342 and reduces the stepping motor current to a holding value. The microcontroller then returns to block 294 and awaits a new start signal.

The microcontroller 278 may be programmed to carry out various functions other than the control of the stepping motor 254. For example, program routines will typically be provided for regulating the temperature of the heater blocks 64 and 240 for the inking roll and type holder, respectively, based on the thermistor outputs and the input values entered by the operator through the switches 40 of the control unit 36. The microcontroller may also check for open-circuited heating elements, defective thermistors, and other fault conditions. The microcontroller 278 may be programmed to display the number of printing cycles which have elapsed, or the current temperatures of the inking roll and type holder heater blocks, or both, using the LCD array 42 of FIG. 1. A menu of set-up options may also be displayed using the LCD array 42. As a further option, the print cycle counting function may be used to provide the operator with an indication of when the inking roll 112 has been depleted and requires replacement.

Although the present invention has been described with reference to a preferred embodiment, it should be understood that the invention is not limited to the details thereof. A number of possible substitutions and modifications have been suggested in the foregoing detailed description, and others will occur to those of ordinary skill in the art. For example, it will be apparent that the yieldable link 150 need not comprise a strip of spring steel as described, but may instead comprise a coil spring assembly, spring-loaded damper, a spring-loaded knuckle joint, or the like. These and other substitutions and modifications are intended to fall within the scope of the invention as defined in the appended claims.

What is claimed is:

1. A marking apparatus comprising:

a marking member arranged for reciprocating movement into and out of contact with a surface to be marked;

a drive source for imparting reciprocating movement to said marking member, said drive source and said marking member forming part of a load path along which marking pressure is applied to said surface to be marked;

a yieldable member in said load path for preventing excessive marking pressure from being applied between said marking member and the surface to be marked, said yieldable member comprising a strip of resilient material which is adapted to flex in compression at marking pressures in excess of a desired maximum marking pressure;

a sensor for detecting a marking pressure in excess of a desired maximum marking pressure; and a control system coupled to said sensor and said drive source for stopping the motion of said marking member when an excessive marking pressure is detected.

2. A marking apparatus as claimed in claim 1, wherein said yieldable member comprises a movable drive link connecting said drive source to said marking member.

3. A marking apparatus as claimed in claim 1, wherein said drive source comprises a rotary crank mechanism coupled to said movable drive link.

4. A marking apparatus as claimed in claim 1, wherein said length of resilient material comprises a strip of spring steel.

5. A printing apparatus as claimed in claim 1, wherein said control system further comprises a display device for displaying an indication of excessive marking pressure to an operator.

6. A printer as claimed in claim 1, wherein said drive source reciprocates said marking member along a path of movement which is characterized by a predetermined travel in the direction toward a surface to be printed in the absence of marking pressure in excess of a desired maximum marking pressure, and wherein said sensor is positioned to detect the reciprocation of said marking member along said path of movement and to detect a marking pressure in excess of a desired maximum marking pressure by detecting a reduced travel of said marking member along said path of movement when said marking member is brought into contact with a surface to be printed.

7. A printer as claimed in claim 6, wherein said sensor comprises a proximity detector mounted at a fixed position along said path of movement to intermittently detect a portion of said marking member during the interval in which the marking member moves past the sensor and is brought into contact with the surface to be printed at normal marking pressures, and wherein said control system responds to continuous detection of said portion of said marking member during said interval by stopping the motion of said marking member.

8. A marking apparatus comprising:

a marking member for marking a surface by undergoing reciprocating movement into and out of contact therewith;

a drive source for imparting reciprocating movement to said marking member;

a sensor for detecting a marking pressure applied by the reciprocating movement of said marking member that is in excess of a desired maximum marking pressure; and a control system coupled to said sensor and said drive source for stopping the reciprocating movement of said marking member when an excessive marking pressure is detected; and further wherein:

said sensor is arranged to detect a marking pressure in excess of a desired maximum marking pressure by detecting a reduced travel of said marking member when said marking member is brought into contact with a surface to be printed;

said sensor comprises a proximity detector mounted at a fixed position along said path of movement to intermittently detect a portion of said marking member during the interval in which the marking member moves past the sensor and is brought into contact with the surface to be printed at normal marking pressures; and said control system responds to continuous detection of said portion of said marking member during said interval by stopping the motion of said marking member.

9. A marking apparatus comprising:

a marking member for marking a surface by undergoing reciprocating movement into and out of contact therewith;

a drive source for imparting reciprocating movement to said marking member;

a sensor for detecting a marking pressure applied by the reciprocating movement of said marking member that is in excess of a desired maximum marking pressure;

a control unit coupled to said sensor; and a display device coupled to said control unit for displaying an indication of excessive marking pressure to an operator.

10. A marking apparatus as claimed in claim 9, wherein said drive source reciprocates said marking member along a path of movement which is characterized by a predetermined travel in the direction toward a surface to be printed in the absence of marking pressure in excess of a desired maximum marking pressure, and wherein said sensor is positioned to detect the reciprocation of said marking member along said path of movement and to detect a marking pressure in excess of a desired maximum marking pressure by detecting a reduced travel of said marking member along said path of movement when said marking member is brought into contact with a surface to be printed.

11. A marking apparatus as claimed in claim 10, wherein said sensor comprises a proximity detector mounted at a fixed position along said path of movement to intermittently detect a portion of said marking member during the interval in which the marking member moves past the detector and is brought into contact with the surface to be printed at normal marking pressures, and wherein said control unit responds to continuous detection of said portion of said marking member during said interval by causing said display device to display an indication of excessive marking pressure.

12. A method for limiting the maximum marking pressure in a marking apparatus comprising a marking member arranged for reciprocating movement into and out of contact with a surface to be printed and a drive source for said marking member, said drive source and said marking member forming part of a load path along which marking pressure is applied to said surface to be printed, said method comprising the steps of interposing in said load path a resilient member having a non-linear restoring force characteristic, causing said resilient member to yield in response to a marking pressure in excess of a desired maximum marking pressure, detecting the yielding of said resilient member and stopping operation of said drive source in response to said detection.

13. A method for limiting the maximum marking pressure in a marking apparatus comprising a marking member arranged for reciprocating movement into and out of contact with a surface to be printed and a drive source for said marking member, said drive source and said marking member forming part of a load path along which marking pressure is applied to said surface to be printed, said method comprising the steps of interposing in said load path a resilient member having a non-linear restoring force characteristic, causing said resilient member to yield in response to a marking pressure in excess of a desired maximum marking pressure, detecting the yielding of said resilient member and displaying an indication of excessive marking pressure in response to said detection.

14. A method for detecting an excessive marking pressure in a marking apparatus comprising a marking member for marking a surface by undergoing reciprocating movement into and out of contact therewith during successive marking strokes and a drive source for reciprocating said marking member, said method comprising the steps of detecting a reduced travel of said marking member when said marking member is brought into contact with a surface to be marked during a marking stroke, and displaying an indication of excessive marking pressure in response to said detection.

15. A method as claimed in claim 14, further comprising the step of stopping the operation of said drive source in response to said detection.

16. A method as claimed in claim 14, wherein the step of detecting a reduced travel of said marking member comprises the step of detecting the motion of said marking member past a sensor.

17. A marking apparatus comprising:

a marking member arranged for reciprocating movement into and out of contact with a surface to be marked;

a drive source for imparting reciprocating movement to said marking member;

a movable drive link connecting said drive source to said marking member, said movable drive link being yieldable to prevent excessive marking pressure from being applied between said marking member and the surface to be marked;

a sensor for detecting a marking pressure in excess of a desired maximum marking pressure; and a control system coupled to said sensor and said drive source for stopping the motion of said marking member when an excessive marking pressure is detected.

18. A marking apparatus as claimed in claim 17, wherein said drive source comprises a rotary crank mechanism coupled to said movable drive link.

19. A marking apparatus as claimed in claim 17, wherein said movable drive link comprises a length of resilient material which is adapted to flex at marking pressures in excess of a desired maximum marking pressure.

20. A marking apparatus as claimed in claim 19, wherein said length of resilient material comprises a strip of spring steel.

21. A printing apparatus as claimed in claim 17, wherein said control system further comprises a display device for displaying an indication of excessive marking pressure to an operator.

22. A printer as claimed in claim 17, wherein said drive source reciprocates said marking member along a path of movement which is characterized by a predetermined travel in the direction toward a surface to be printed in the absence of marking pressure in excess of a desired maximum marking pressure, and wherein said sensor is positioned to detect the reciprocation of said marking member along said path of movement and to detect a marking pressure in excess of a desired maximum marking pressure by detecting a reduced travel of said marking member along said path of movement when said marking member is brought into contact with a surface to be printed.

23. A printer as claimed in claim 22, wherein said sensor comprises a proximity detector mounted at a fixed position along said path of movement to intermittently detect a portion of said marking member during the interval in which the marking member moves past the sensor and is brought into contact with the surface to be printed at normal marking pressures, and wherein said control system responds to continuous detection of said portion of said marking member during said interval by stopping the motion of said marking member.

24. A method for limiting the maximum marking pressure in a marking apparatus comprising a marking member arranged for reciprocating movement into and out of contact with a surface to be printed, a drive source for said marking member, and a movable drive link connecting said printing member to said drive source, said method comprising the steps of causing said movable drive link to yield in response to a marking pressure in excess of a desired maximum marking pressure, detecting the yielding of said movable drive link and stopping operation of said drive source in response to said detection.

25. A method as claimed in claim 24, further comprising the steps of detecting the yielding of said movable drive link and displaying an indication of excessive marking pressure in response to said detection.

26. A marking apparatus comprising:

a marking member arranged for reciprocating movement into and out of contact with a surface to be marked during successive marking cycles;

a drive source coupled to said marking member for imparting reciprocating movement thereto;

a home position sensor for detecting a predetermined home position of said marking member in proximity to said surface, said home position sensor producing a first output during a marking cycle in which the marking pressure applied to said surface by said marking member is within a desired range and a second output during a marking cycle in which the marking pressure applied to said surface by said marking member is in excess of a desired maximum marking pressure; and a control system coupled to said drive source and to said home position sensor for controlling the operation of said marking apparatus in accordance with said first and second outputs.

27. A marking apparatus as claimed in claim 26, wherein:

said control system is responsive to a start command for initiating each successive marking cycle;

said control system is operative to stop the reciprocating movement of said marking member and to await said start command when said home position sensor produces said first output; and said control system is operative to stop the reciprocating movement of said marking member and to ignore said start command when said home position sensor produces said second output.

28. A marking apparatus as claimed in claim 26, wherein said control system further comprises a display device, and further wherein:

said control system is responsive to a start command for initiating each successive marking cycle;

said control system is operative to stop the reciprocating movement of said marking member and to await said start command when said home position sensor produces said first output; and said control system is operative to stop the reciprocating movement of said marking member and to display an indication of excessive marking pressure using said display device when said home position sensor produces said second output.

29. A marking apparatus as claimed in claim 26, wherein said home position sensor is arranged to detect a marking pressure in excess of a desired marking pressure by detecting a reduced travel of said marking member between said home position and said surface.

30. A marking apparatus as claimed in claim 26, wherein said first and second outputs comprise different numbers of signal transitions produced at the output of said home position sensor, and wherein said control system includes a counter for counting said signal transitions.

31. A method for operating a marking apparatus comprising a marking member arranged for reciprocating movement into and out of contact with a surface to be printed during successive marking cycles, said method comprising the steps of providing a home position sensor to detect a predetermined home position of said marking member in proximity to said surface, and detecting an abnormal output of said home position sensor to provide an indication that the marking pressure applied to said surface by said marking member during a marking cycle is in excess of a desired maximum value.

32. A method as claimed in claim 31, further comprising the step of inhibiting further marking cycles in response to the detection of an abnormal output from said home position sensor.

33. A method as claimed in claim 31, further comprising the step of displaying an indication of excess marking pressure in response to the detection of an abnormal output from said home position sensor.

* * * * *

UNITED STATES PATENT AND TRADEMARK OFFICE

CERTIFICATE OF CORRECTION

PATENT NO. : 5,503,070
DATED : April 2, 1996
INVENTOR(S) : James M. Cheever, et. al.

It is certified that error appears in the above-indentified patent and that said Letters Patent is hereby corrected as shown below:

Title page, item [75], inventorship should read as follows:

Inventors: James M. Cheever, Keene; Richard H. Frye, Westmoreland; Gary F. Fowler, Keene; Edward E. Freyenhagen, Jr., Keene, all of N.H.

William E. Maxwell is deleted as an inventor.

Signed and Sealed this

Twenty-eighth Day of July, 1998

*Attest:*

*Attesting Officer*

Bruce Lehman

BRUCE LEHMAN

*Commissioner of Patents and Trademarks*